US007823968B2

(12) United States Patent
Long et al.

(10) Patent No.: US 7,823,968 B2
(45) Date of Patent: Nov. 2, 2010

(54) L AND R FOLDING CHAIR WITH HOOD

(76) Inventors: Lee Autry Long, 5409 Chestnut Ave., Kansas City, MO (US) 64130; Ronald Levester Long, Sr., 151 Wood lawn Trace, Brighton, TN (US) 38011

( * ) Notice: Subject to any disclaimer, the term of this patent is extended or adjusted under 35 U.S.C. 154(b) by 0 days.

(21) Appl. No.: 12/082,727

(22) Filed: Apr. 14, 2008

(65) Prior Publication Data

US 2009/0174231 A1 Jul. 9, 2009

Related U.S. Application Data

(60) Provisional application No. 61/009,807, filed on Jan. 3, 2008.

(51) Int. Cl.
*A47C 7/66* (2006.01)

(52) U.S. Cl. ..... 297/184.15; 297/184.11

(58) Field of Classification Search ..... 297/184.1, 297/184.11, 184.12, 184.15, 184.16
See application file for complete search history.

(56) References Cited

U.S. PATENT DOCUMENTS 4,072,345 A * 2/1978 Matsuda ..... 297/184.15
4,083,601 A * 4/1978 McBeth ..... 297/184.14
4,112,957 A * 9/1978 Biven ..... 135/87
4,687,249 A * 8/1987 Mills ..... 297/184.15
4,711,494 A * 12/1987 Duvenkamp ..... 297/403
5,168,889 A * 12/1992 Diestel ..... 135/88.01
5,437,061 A * 8/1995 Kenner ..... 2/69
5,542,732 A * 8/1996 Pollman ..... 296/77.1
5,582,458 A * 12/1996 Wildt ..... 297/184.15
6,371,553 B1 * 4/2002 Tang ..... 297/184.1
6,508,512 B2 * 1/2003 Saberan et al. ..... 297/408
7,140,678 B1 * 11/2006 Grant ..... 297/184.15
7,198,324 B2 * 4/2007 Le Gette et al. ..... 297/16.2
7,431,388 B2 * 10/2008 Sharapov ..... 297/184.11
2006/0181121 A1 * 8/2006 Delapaz ..... 297/219.12

FOREIGN PATENT DOCUMENTS

CA 2501762 A1 * 9/2006
JP 59014530 A * 1/1984

* cited by examiner

*Primary Examiner*—Joseph F Edell

(57) ABSTRACT

One embodiment of the folding chair with a hood combination includes a detachable hood, which is located on the rear of the seat assembly. By squeezing the safety clip will release the hood rods. Then raising inserted rod by hand in extended position until the rod base lock in place. Release the rod arms to lock in the notch of the rear support poles. Allowing the hinge where the rod arm and the rod base are connected to fold. Remove hood from pouch located on the rear of the seat assembly. Then place front end of the hood arrow pockets inside the arrow tips of rod assembly. Further attach the back end of detachable hood with fasteners inside the pouch located on rear seat assembly.

6 Claims, 31 Drawing Sheets

9a 9b 17 a 17 b 20 a 20 b 21 a 21 b 25 a 25 b 26 a 26 b 27 a 27 b

L AND R FOLDING CHAIR WITH HOOD

CROSS-REFERENCE TO RELATED APPLICATIONS

Due to safety procedures the following modifications to application 61/009,807 filed Jan. 3, 2008 pertains to L&R folding chair with hood. The following modification are added: the plastic safety lock is an added feature, as a safety precaution to prevent the rod from sliding out while in the fold position.

STATEMENT REGARDING FEDERALLY SPONSORED RESEARCH OR DEVELOPMENT

"Not Applicable"

THE NAMES OF THE PARTIES TO JOINT RESEARCH AGREEMENT

"Not Applicable"

BACKGROUND OF THE INVENTION

1. Field of Invention

The present invention relates to a preexisting art with new features added suitable For sites such as the beach, parade, outdoor activities where the sun is present.

2. Description of Related Art with increasing demand of less UV rays and sun exposure such as with outdoors activities a folding chair with a hood is very practical. The folding chair generally uses a structural skeleton frame. The arms of the L and R folding hood chair can conveniently be folded for packaging, but it can be unfolded smoothly and firm in structure.

The present time, with the increase Of people living level, they not only will be after the folding chair, but considering the smoothness Folding and unfolding of said chair and consider the health quality of L and R chair with hood. And less to carry such as big umbrellas and tents to block out the sun also it is lightweight and easy to store.

BRIEF SUMMARY OF THE INVENTION

The object of the present invention is to provide a folding chair with a hood, a mesh cup holder in each arm of the chair, and a mesh window that can also provide ventilation with a hood that is attachable inside the pouch on the back of the chair with foldable sliding hood rods that are inserted inside the back support poles. Another objective of the invention is to provide a folding chair that is comfortable but also caters to the health issues for both the young and old.

Therefore the present invention puts forward such a folding chair with a pouch with an opening and closing by adhere material on the back top of the chair once the hood is taken out of the pouch it is connected to the tip end of hood rods. Then by hand raise to the extended position until the base end of the hood rod closes in place.

BRIEF DESCRIPTION OF THE DRAWINGS

The drawings are broken down into four categories: Starting with the hood rod assembly. The hood rod assembly is made of three parts with the first part being the rod base. The second part of the assembly is the rod arm. The third part of the assembly is the rod screw end tip or rod arrow.

DETAILED DESCRIPTION OF THE INVENTION

Figure 5:
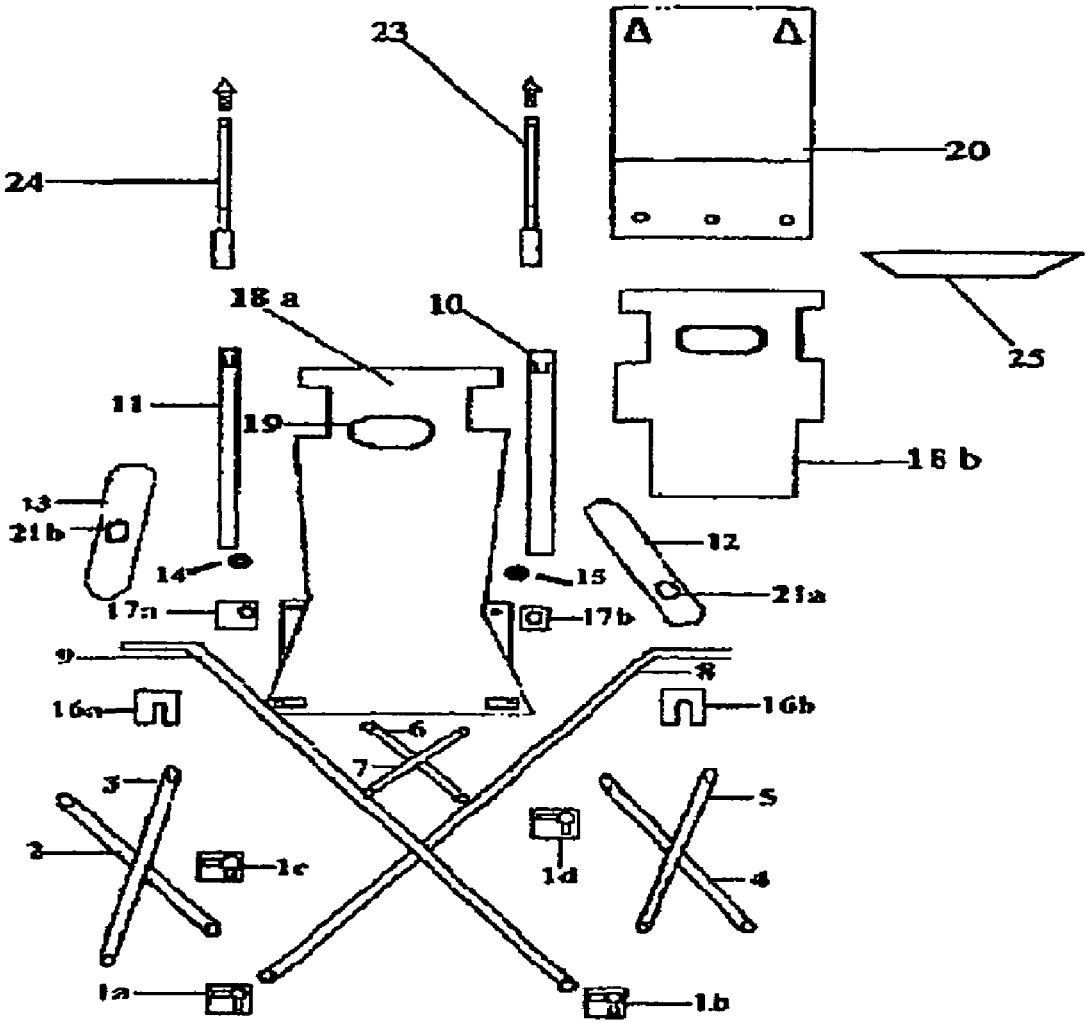
FIG. 5 is an explosion view of multiple parts of the front position.
Figure 6:
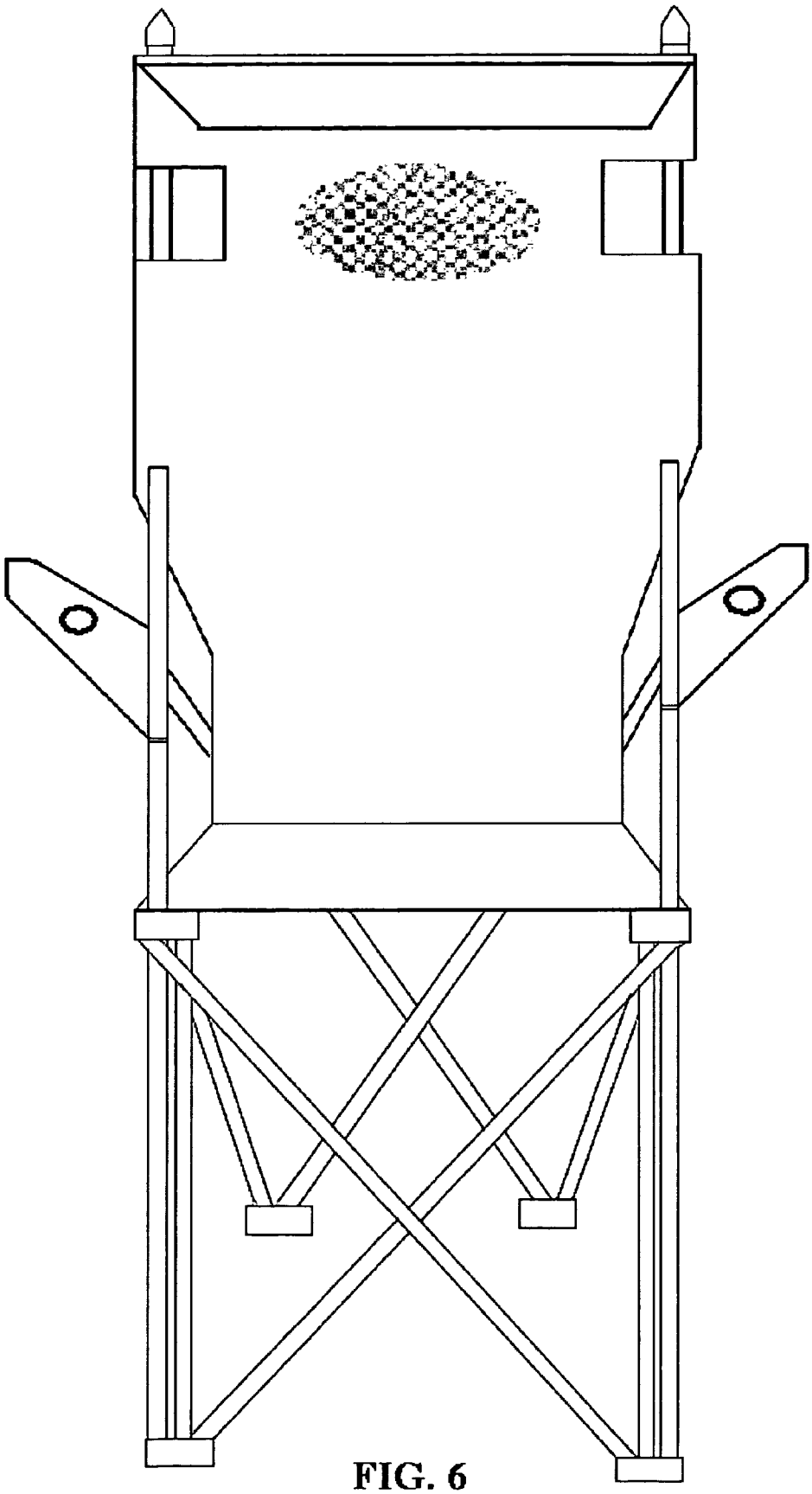
FIG. 6 shows a back view of the L and R hood chair.
Figure 7:
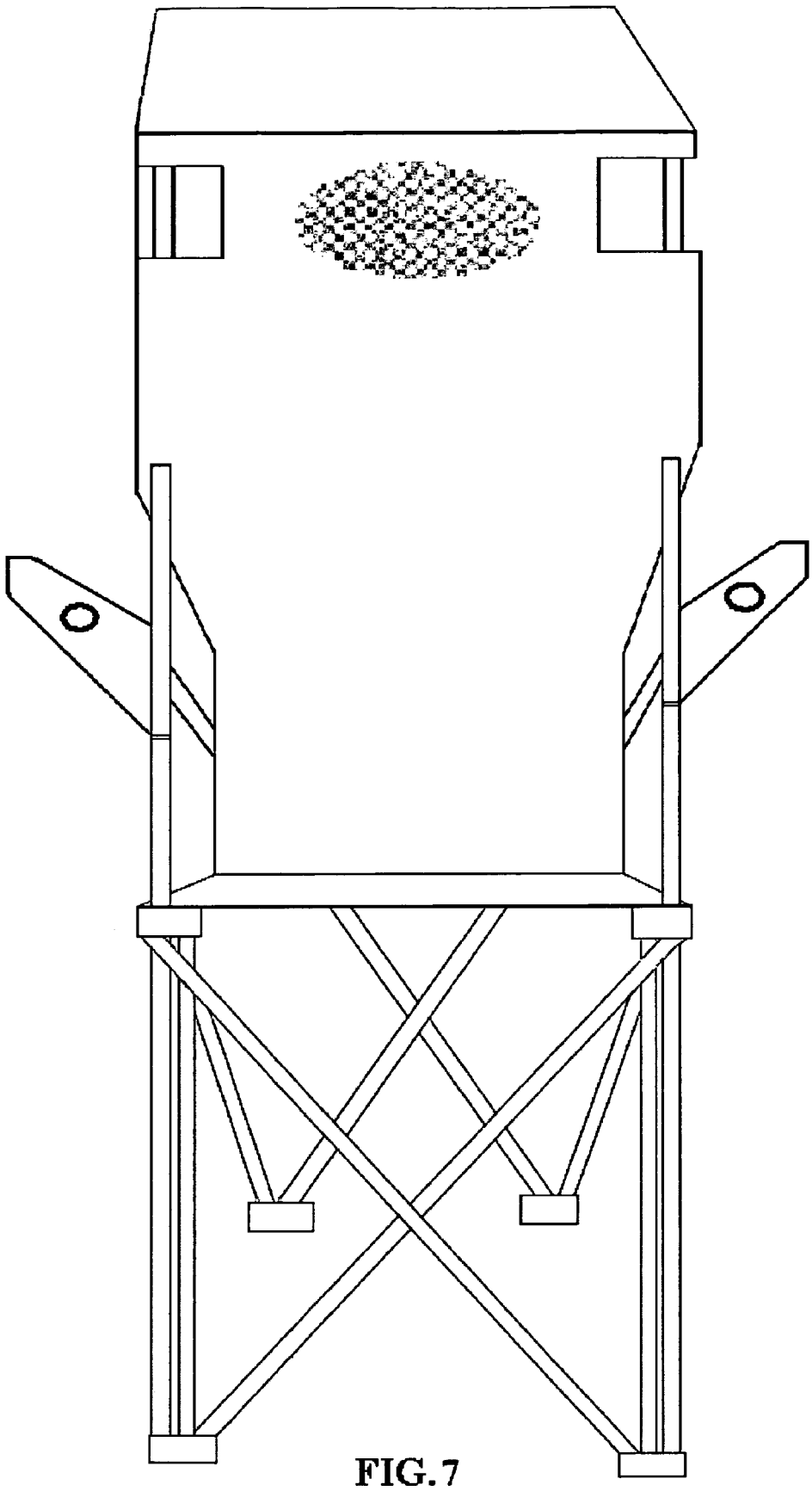
FIG. 7 shows a back view with hood extended.
Figure 8:
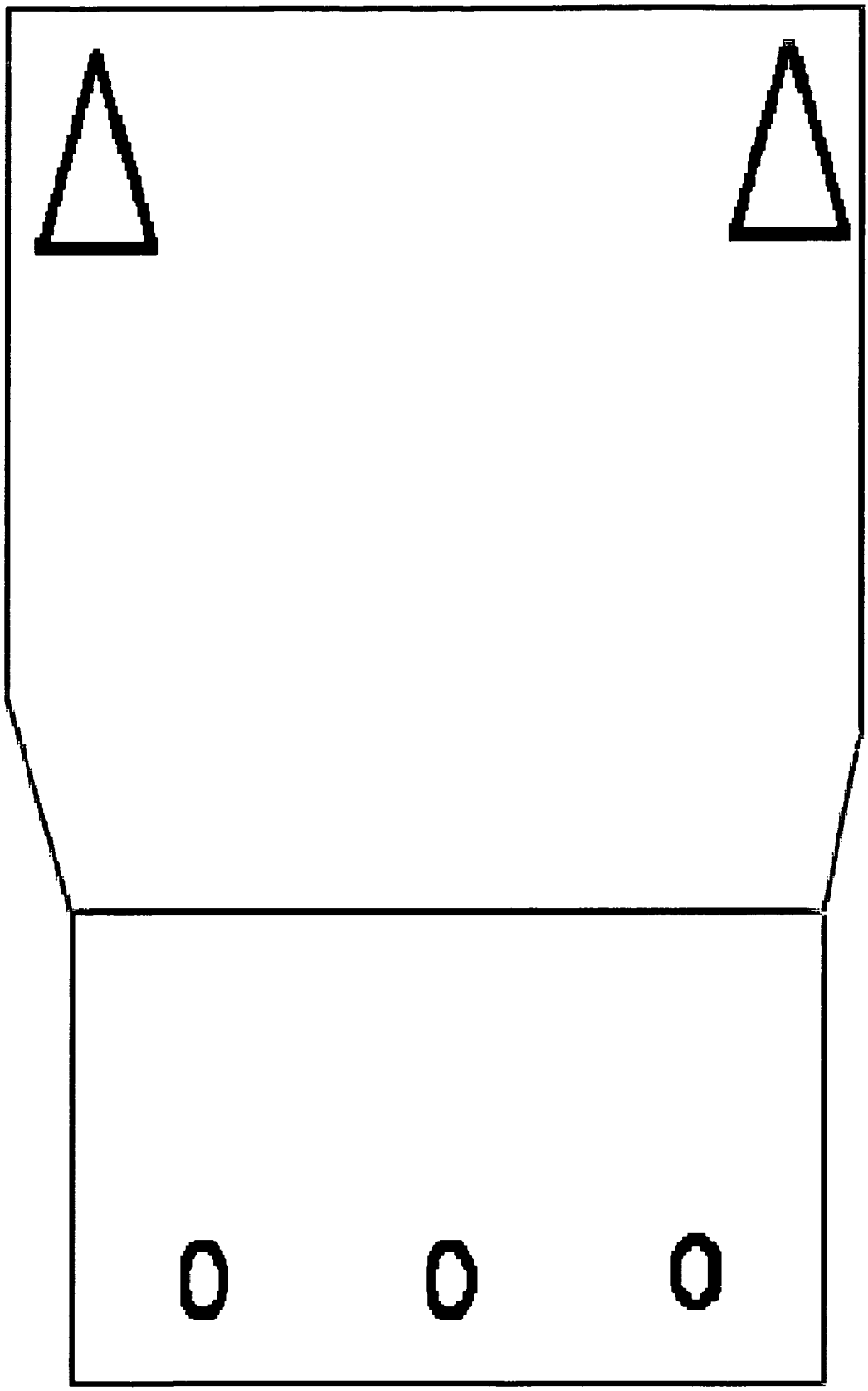
FIG. 8 shows the hood
Figure 12:
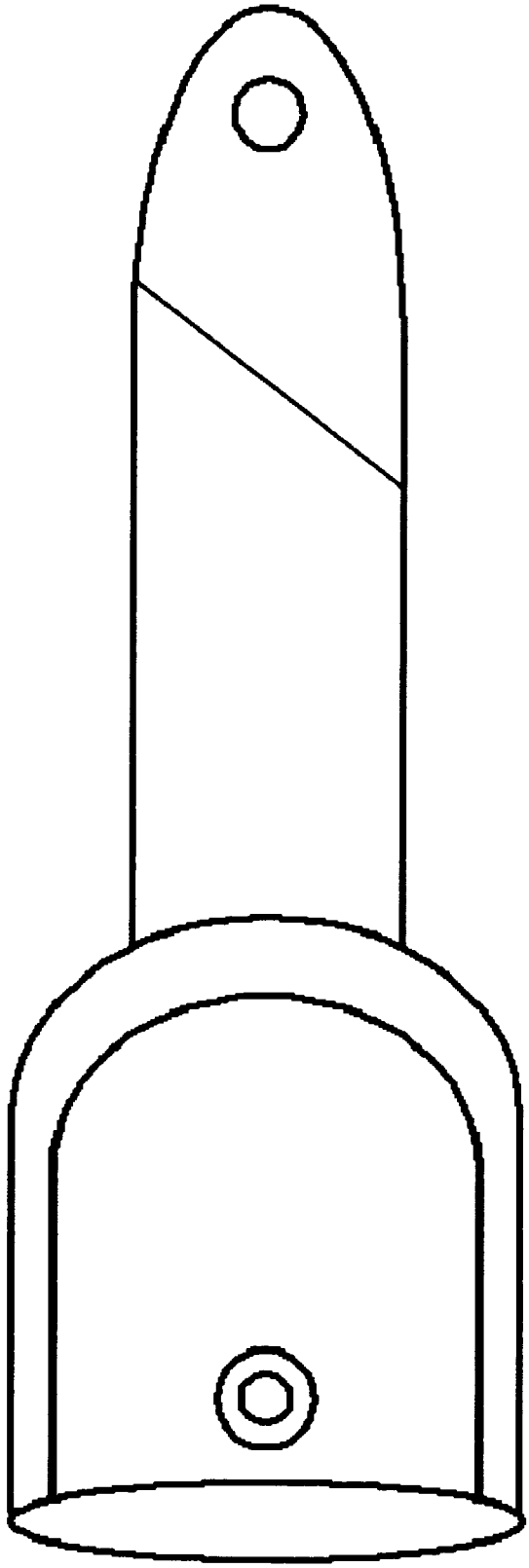
FIG. 12 is the rod base.
Figure 13:
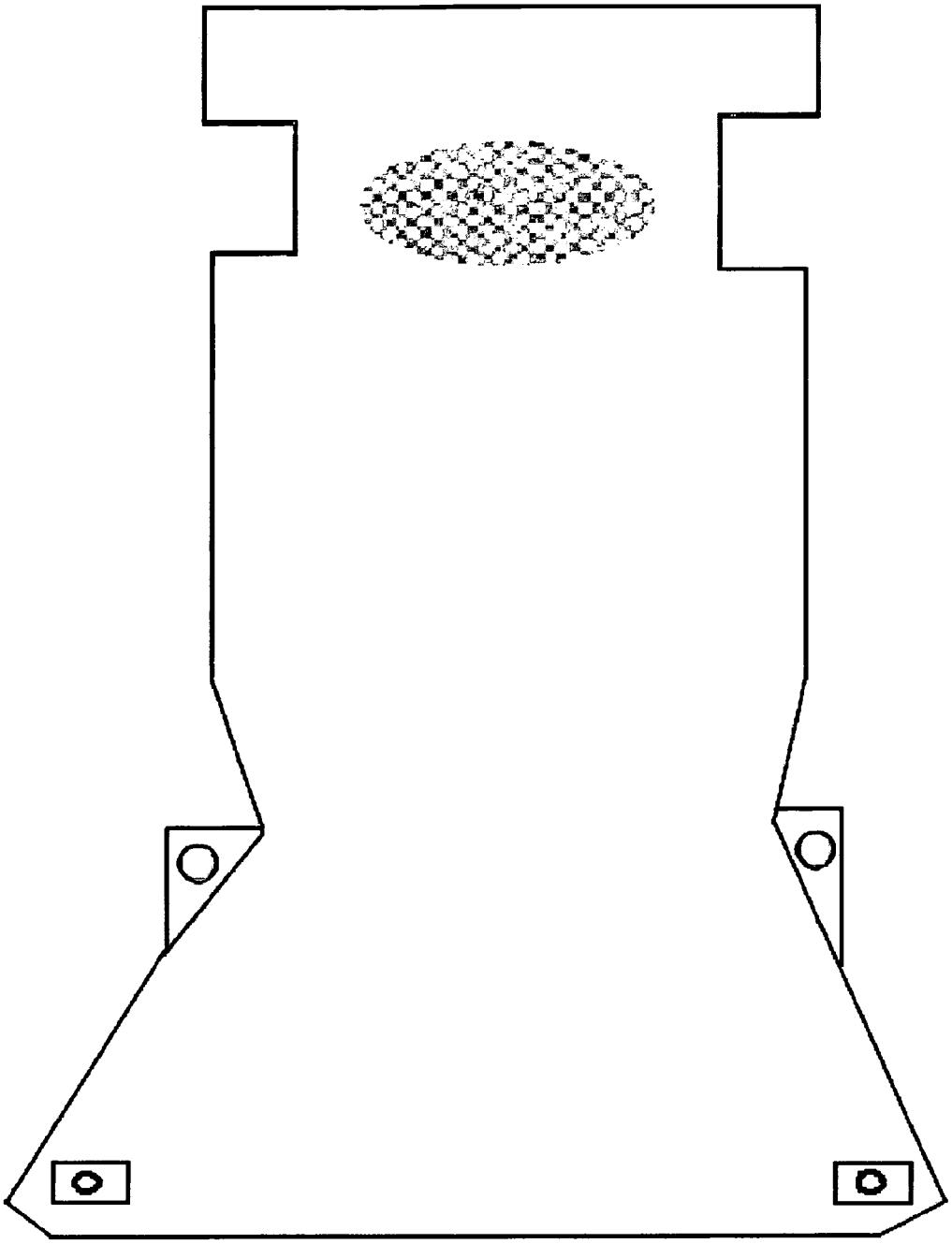
FIG. 13 shows a front view of the seat assembly.
Figure 14:
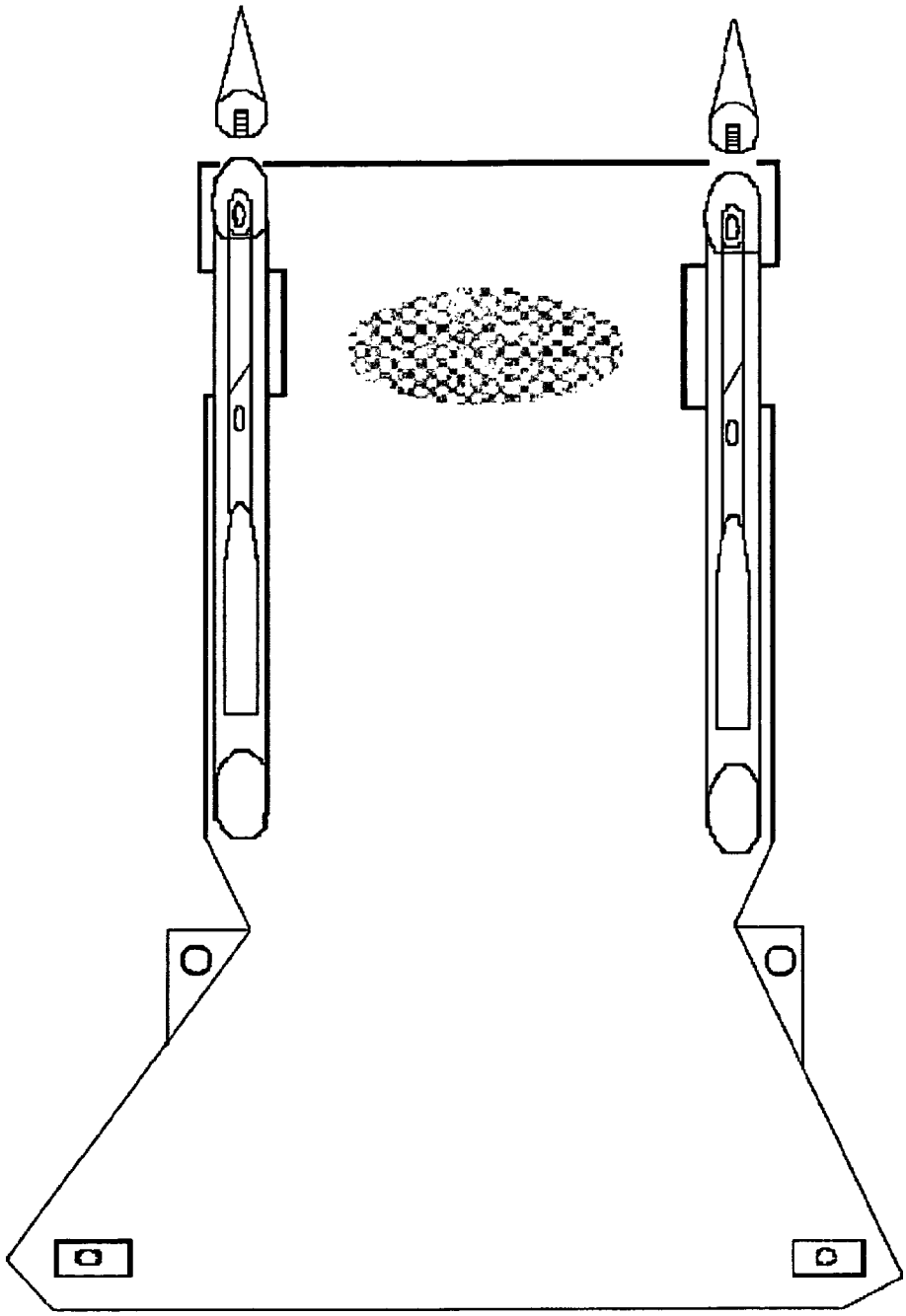
FIG. 14 shows the seat assembly with the rod insert.
Figure 15:
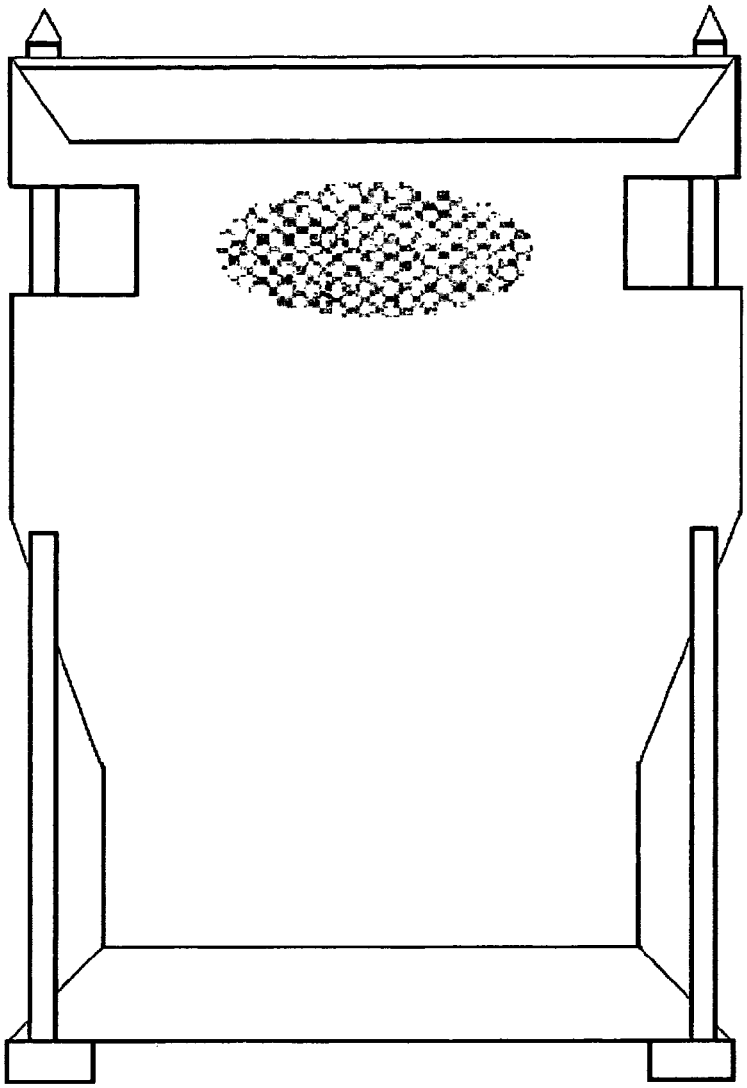
FIG. 15 shows a view of rear inseam.

Starting with FIG. 13 with the seat assembly there are a few modifications made that differ from prior art. An opening that allows ventilation and rear viewing is located on the seat assembly ref #19 as shown in FIG. 5 Also part of the seat assembly is indentions square cut in shape. The sides are left open to allow access for back support poles shown in FIG. 20 to be inserted, open area for the release pins of rod base see FIG. 12 to be accessible.

Figure 20:
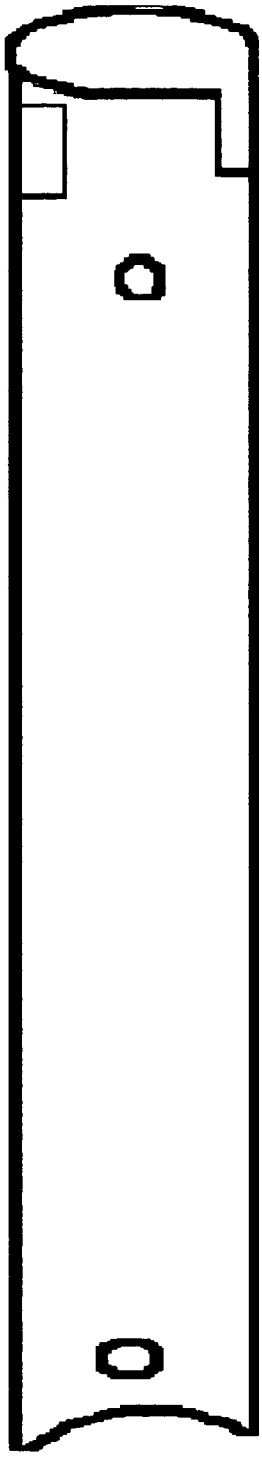
FIGS. 20*a* to 20*b* shows a split view of the left and right back support poles side view.
Figure 20:
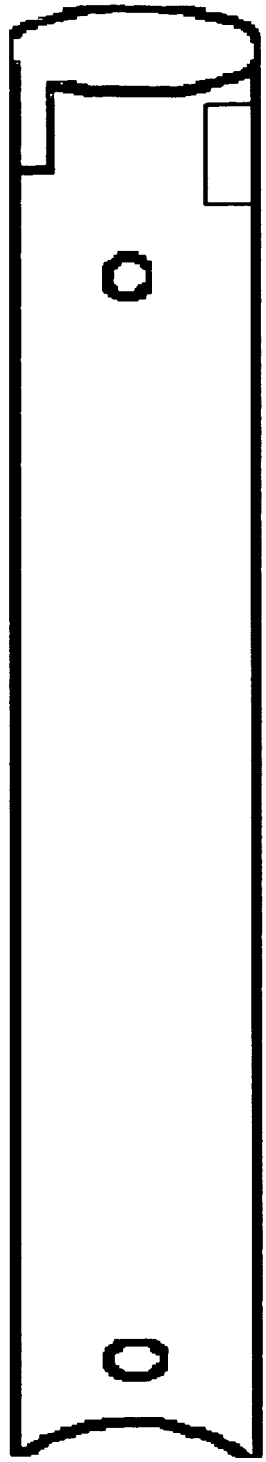
Figure 21:
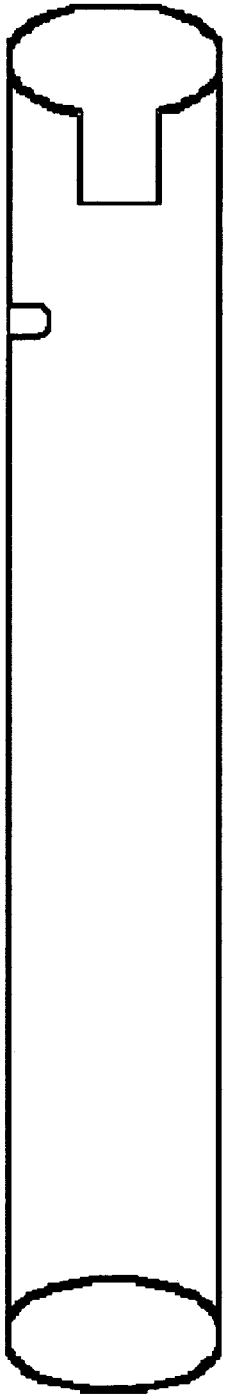
FIGS. 21*a* to 21*b* shows a split view of the left and right back support pole front view.
Figure 21:
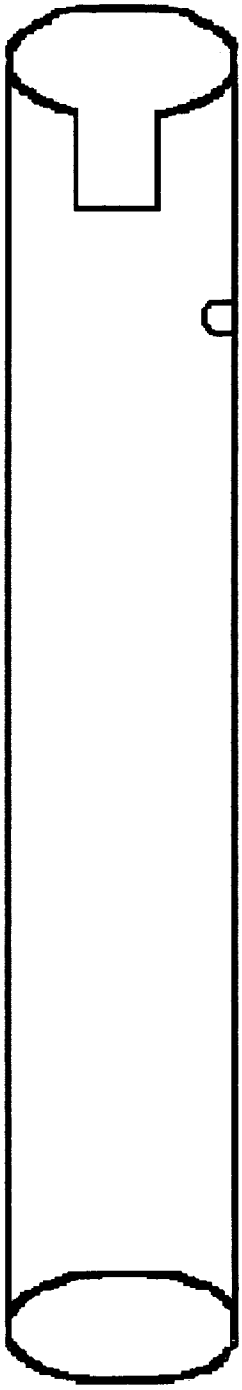

FIG. 20 illustrates modification that has to be made to the back support poles insuring rod insert to function properly. The top end of the back support poles is an open square that is used to allow the rod arm to rest in place shown in FIG. 11 which is part of the rod assembly that is attached to the rod base the square opening where the rod arm will rest while in its extended position. Other modifications to the back support poles is a circular opening for rod base to close in place when extended, and to be pushed in to be released.

Modification on the rear side at the top of the back support poles is a rectangular shape opening. This allows the back end of the rod arm to close in place when in the extended position.

These modifications are part of the rod assembly to close and release. Another modification is the support pole being a size larger than the rod base.

Figure 22:
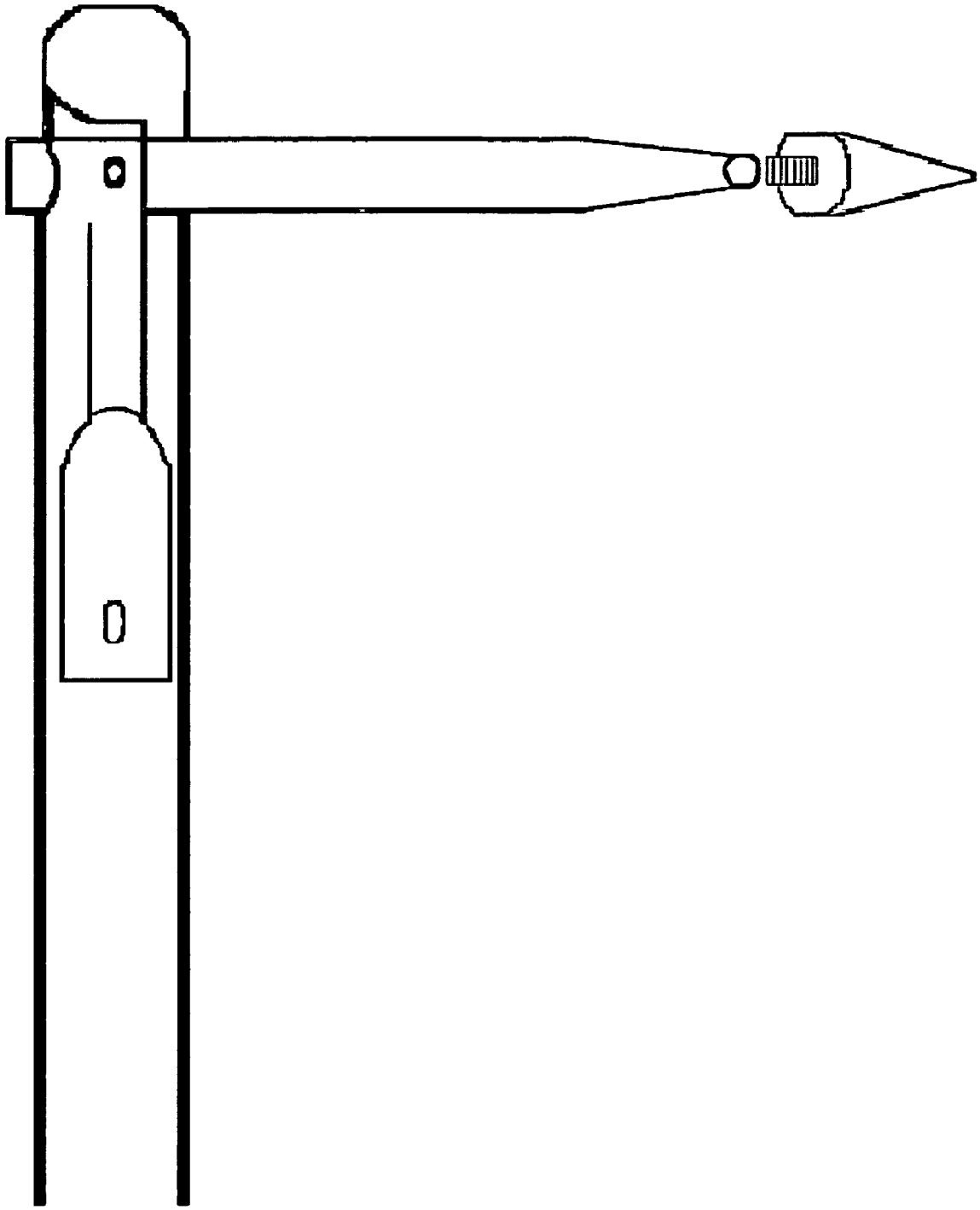
FIG. 22 shows a rod insert to back support pole in its extended position.
Figure 23:
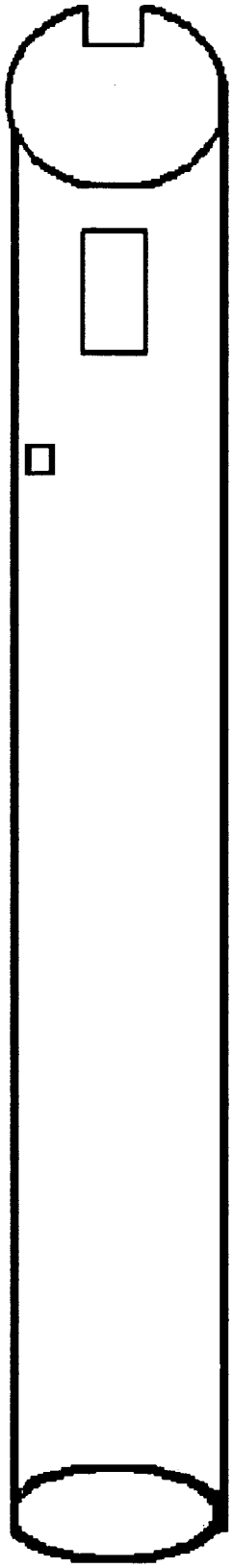
FIG. 23 shows the back support pole back view.
Figure 23:
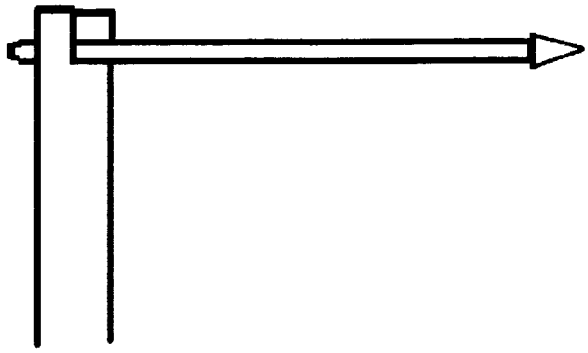

Another part of the invention which is the true part of the invention are the inserted rods used to support the hood. In FIG. 22 shows the complete rod assembly inserted into the back support poles in the extended position. Notice the rod base closes in place inside the back support pole while the rod arm folds resting at the top end of the back support pole. In the reverse motion by raising the rod arm and pushing the rod base release pin inward this action will cause the rod assembly to slide or retract inside the rear support poles. Where rods will reside when not in the extended position.

Figure 10:
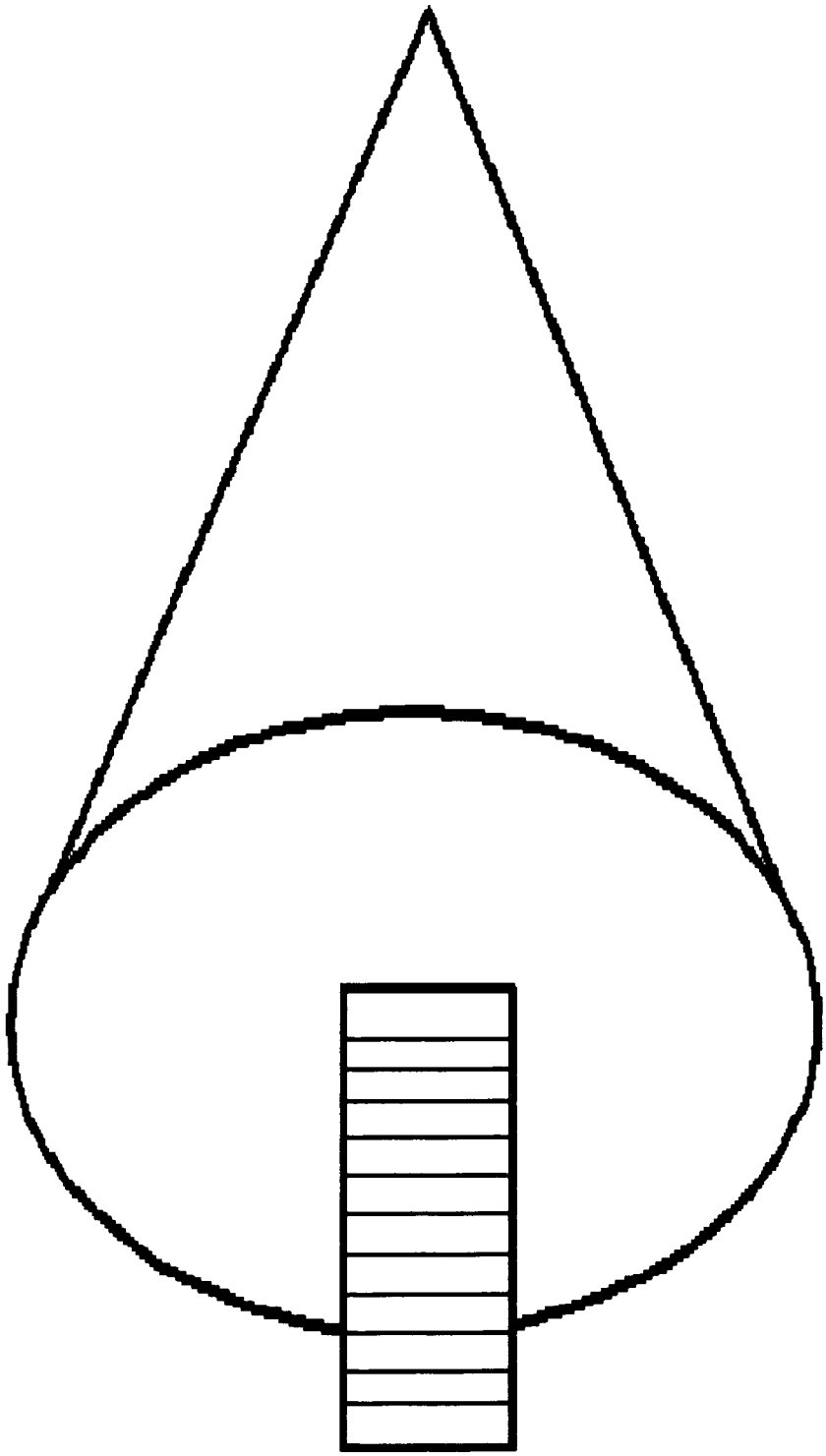
FIG. 10 shows rod arrow tip.
Figure 11:
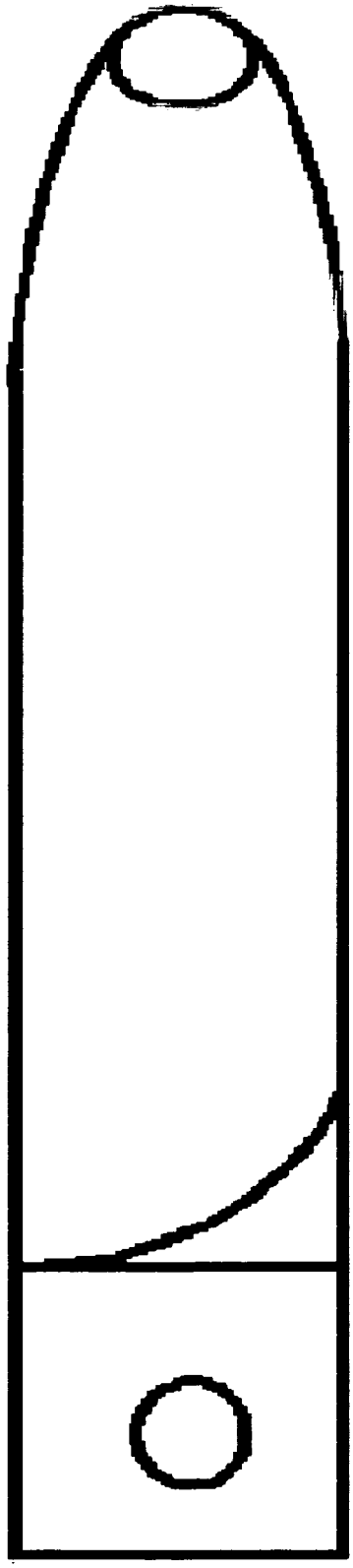
FIG. 11 shows the rod arm.

The rod assembly is made of three parts the rod base shown in FIG. 12 rod arm Shown in FIG. 11 and the rod tip shown in FIG. 10 these three parts make up the rod assembly. The rod base and the rod arm are hinged together allowing a folding motion while the rod tips screw into the rod arm.

Figure 28:
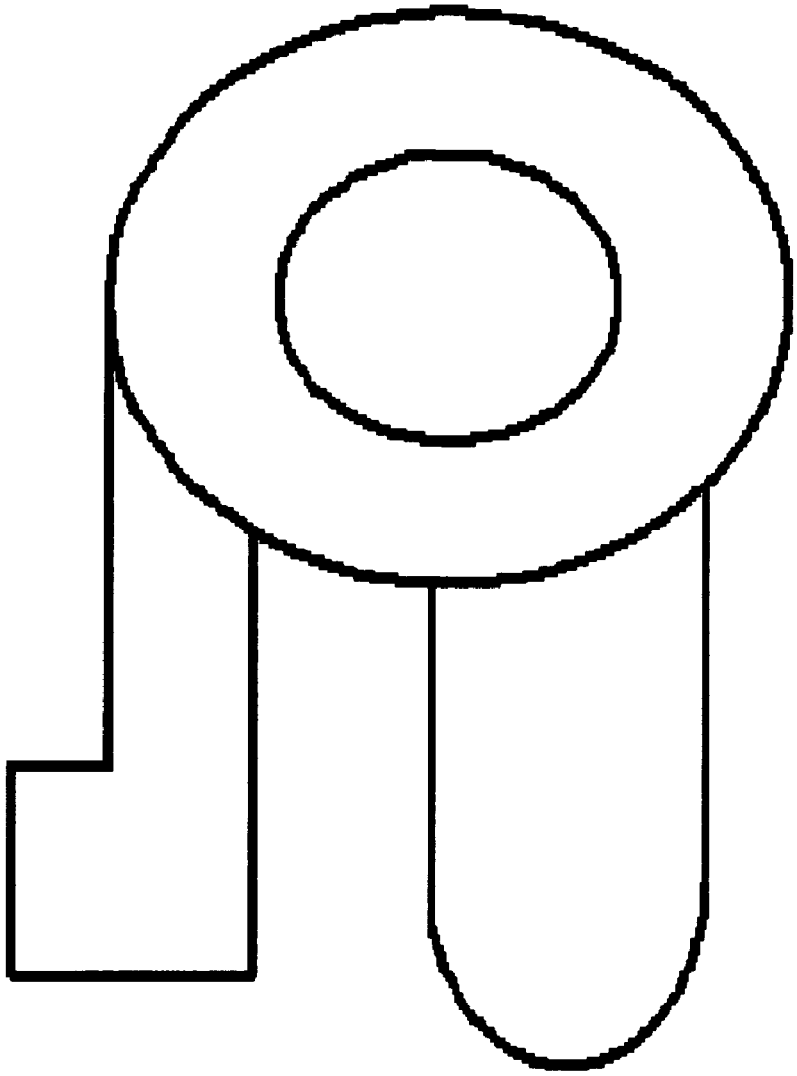
FIG. 28 is a diagram of the safety lock insert.
Figure 29:
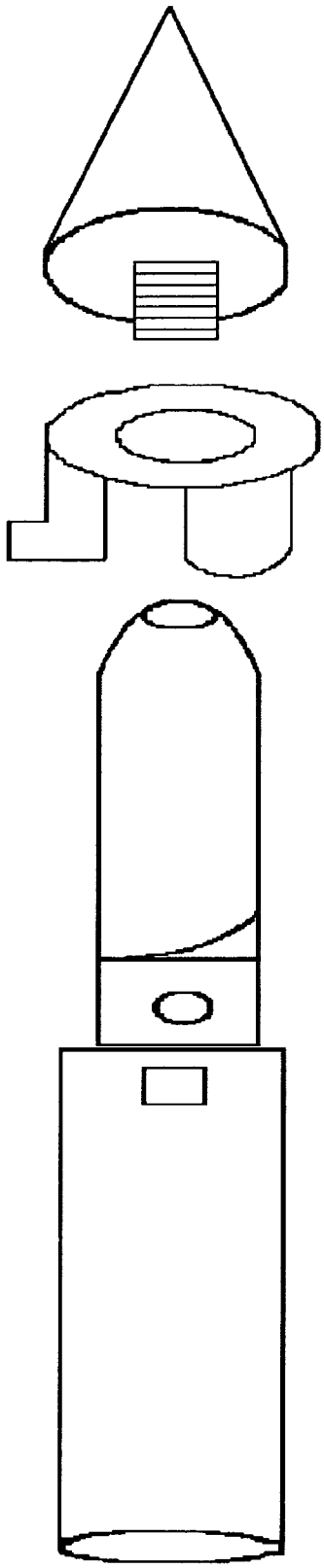
FIG. 29 shows the position of the safety lock insert.
Figure 30:
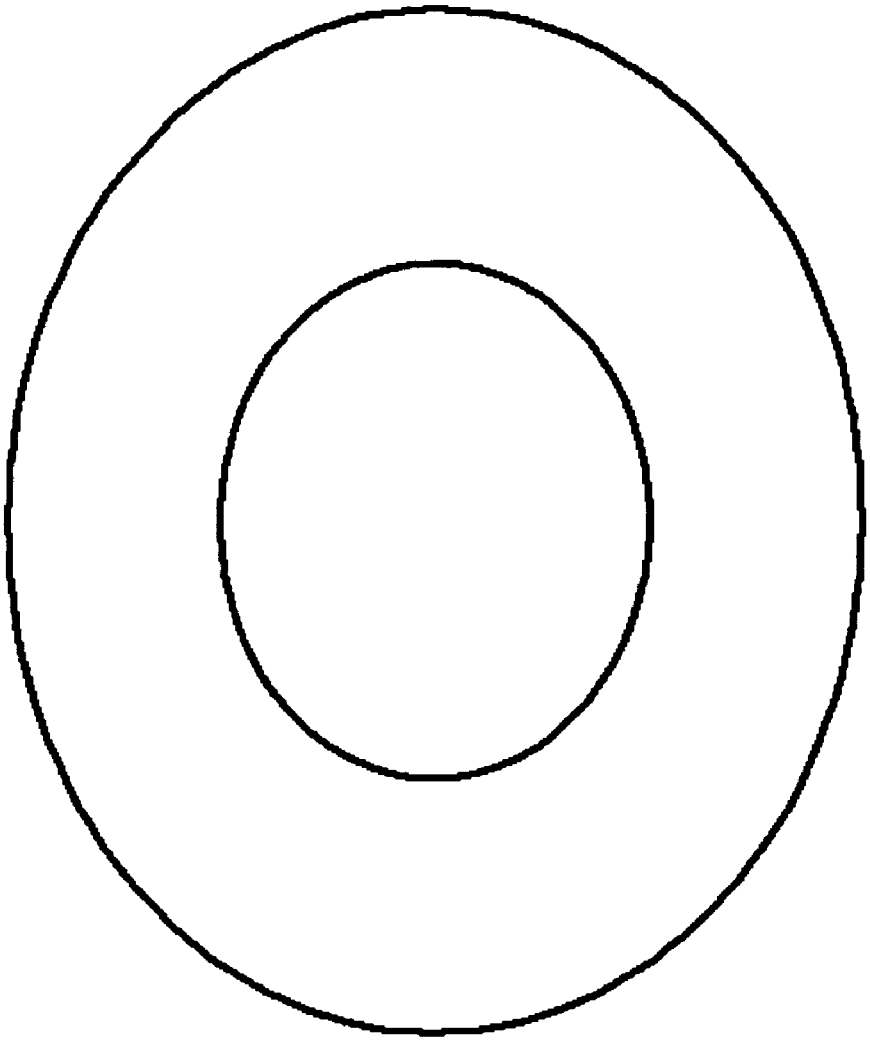
FIG. 30 is a diagram of the sleeve adjuster insert.

Once the rods arms are fully assembled they are placed inside of the back support pole performing a sliding or retractable motion. Between the rod tip and the rod arm a safety lock is placed see FIGS. 28, 29. This safety lock helps prevent the hood rod from slipping when not in use it fits inside the open top end of the back support pole. The safety lock can be squeezed to release the release hood arm the wide end of safety lock fits inside the open cut end of the support pole. While the narrow or notch end of the safety lock is place inside the rectangular shape opening of the support pole.

Figure 9:
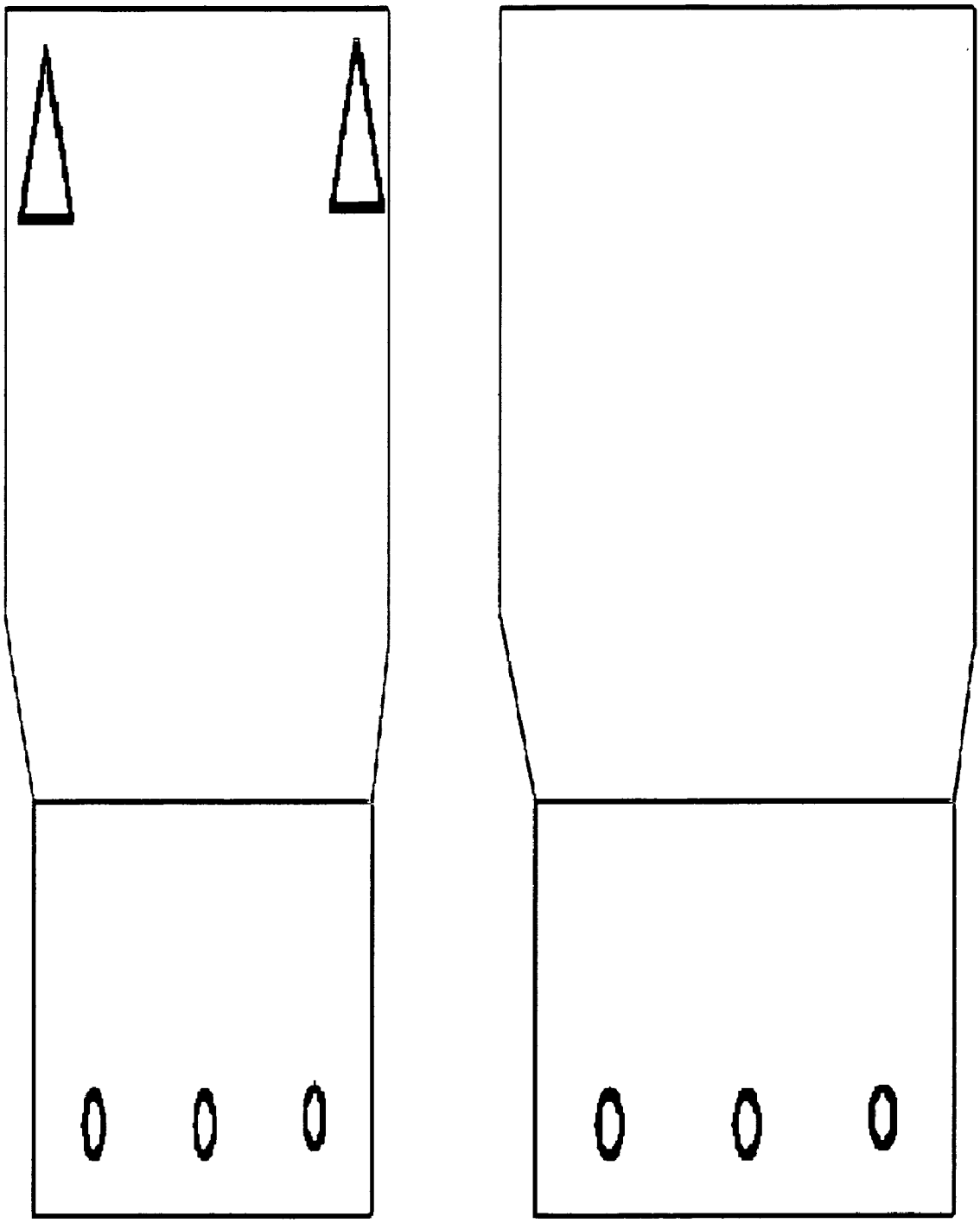
FIGS. 9*a* to 9*b* shows a split view of the hood assembly of the top and bottom.

Another part of the invention is the chair hood the hood is made of a cloth like material but its base end is made of a elastic material. The base end of the hood should also contain three female snap sewn vertically across the base of the hood. FIG. 9 shows both top and bottom of chair hood FIG. 9*a* illustrate two triangular shape pouches. These pouches should be made of elastic material. The tip end of the assembly rods will be place in those pouches when in the extended position.

Figure 16:
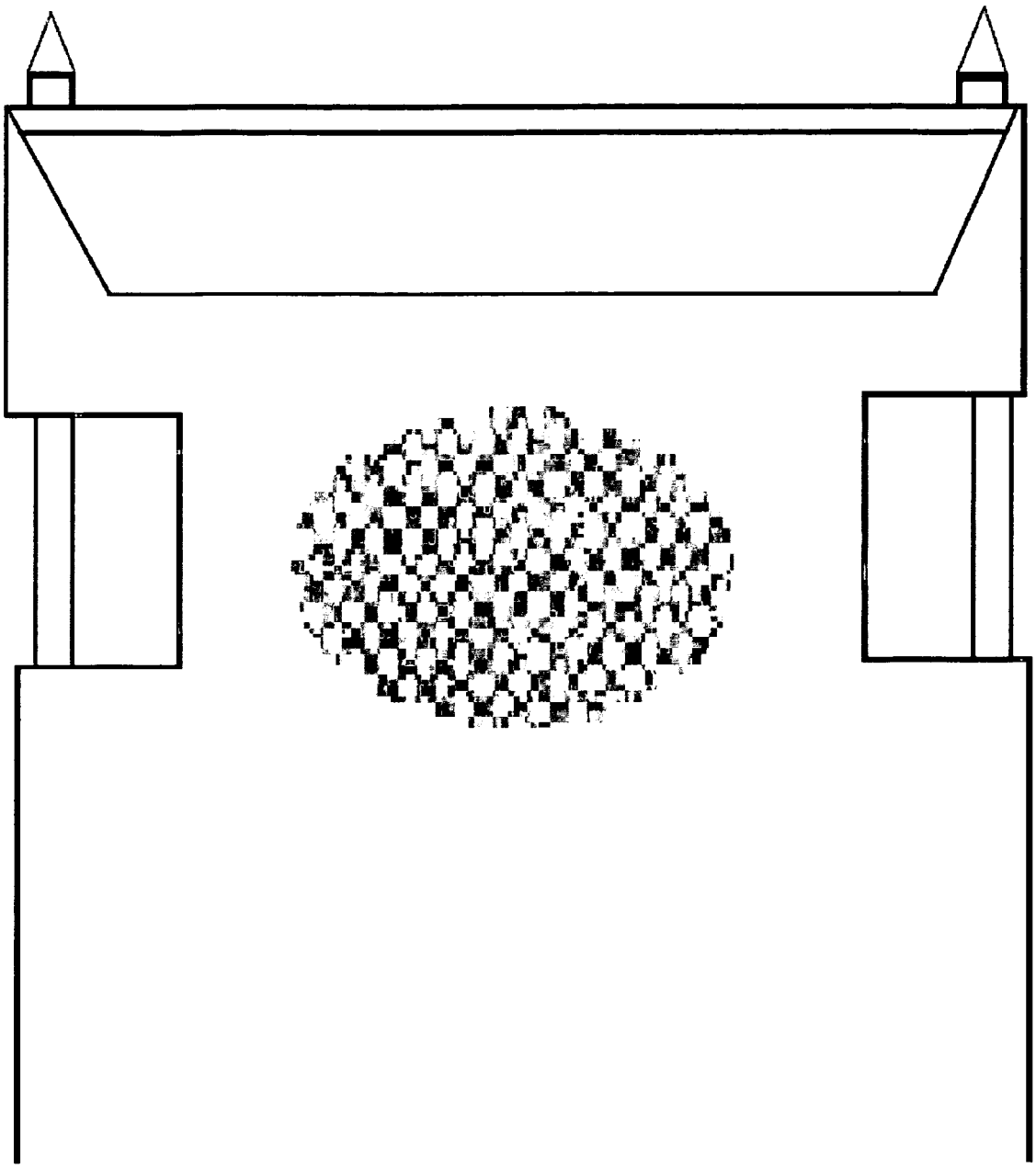
FIG. 16 shows the rear pouch view of the seat assembly.
Figure 17:
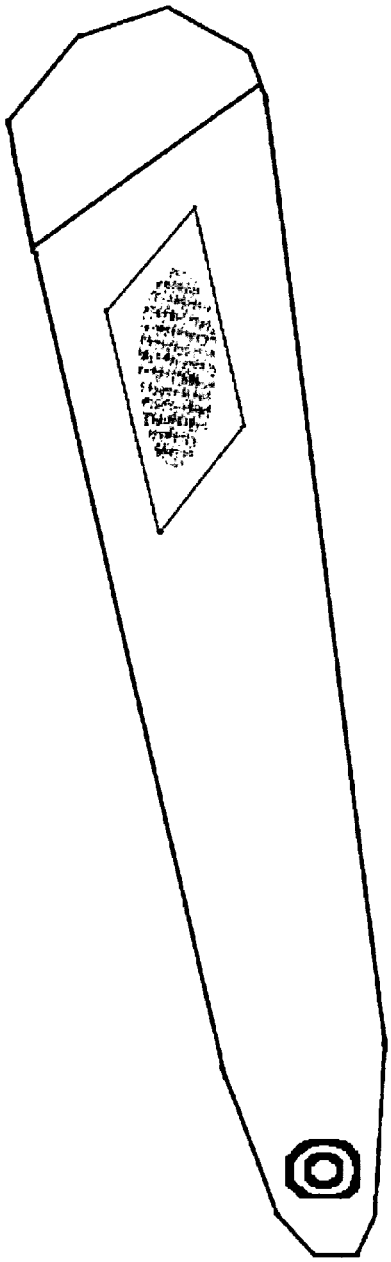
FIGS. 17*a* to 17*b* is a split view of the sleeve assembly.
Figure 17:
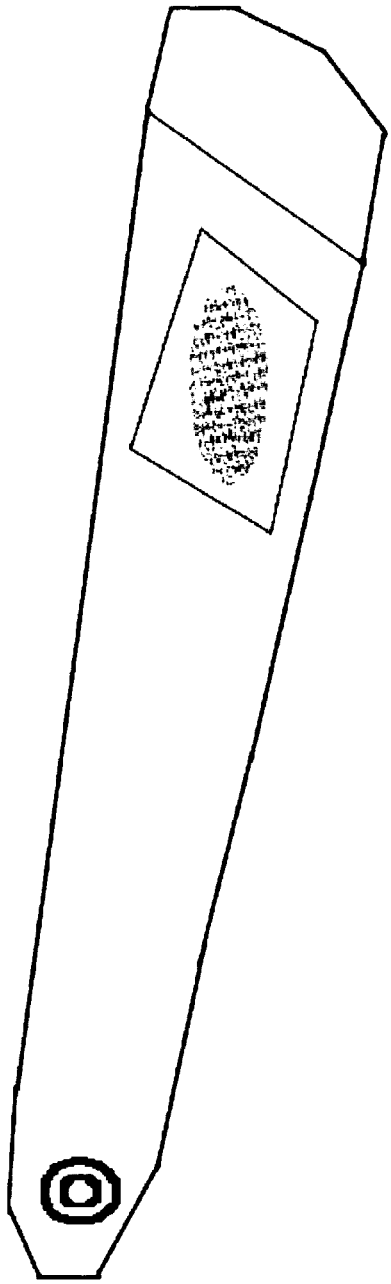
Figure 18:
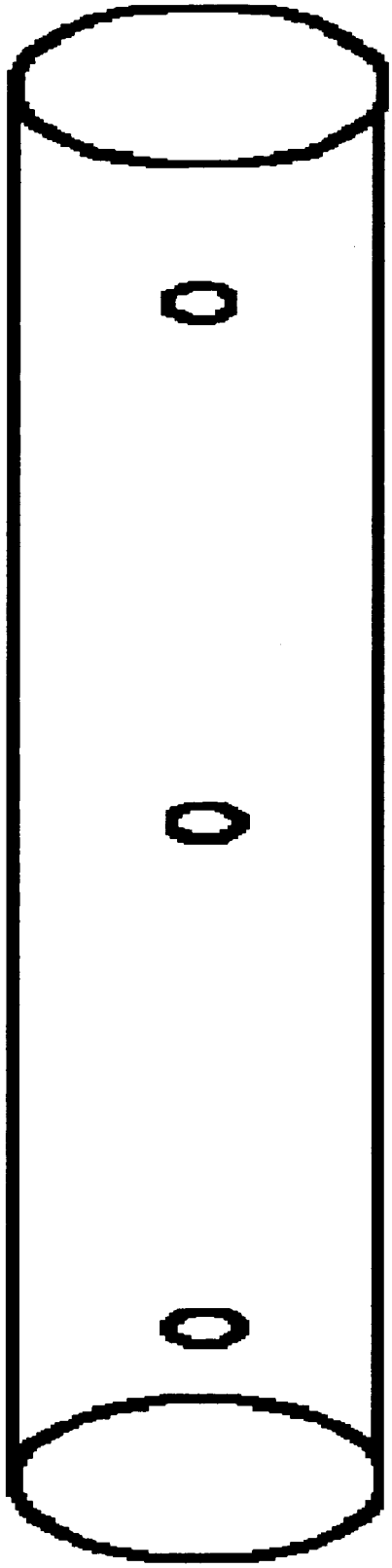
FIG. 18 shows the base support pole side view.
Figure 19:
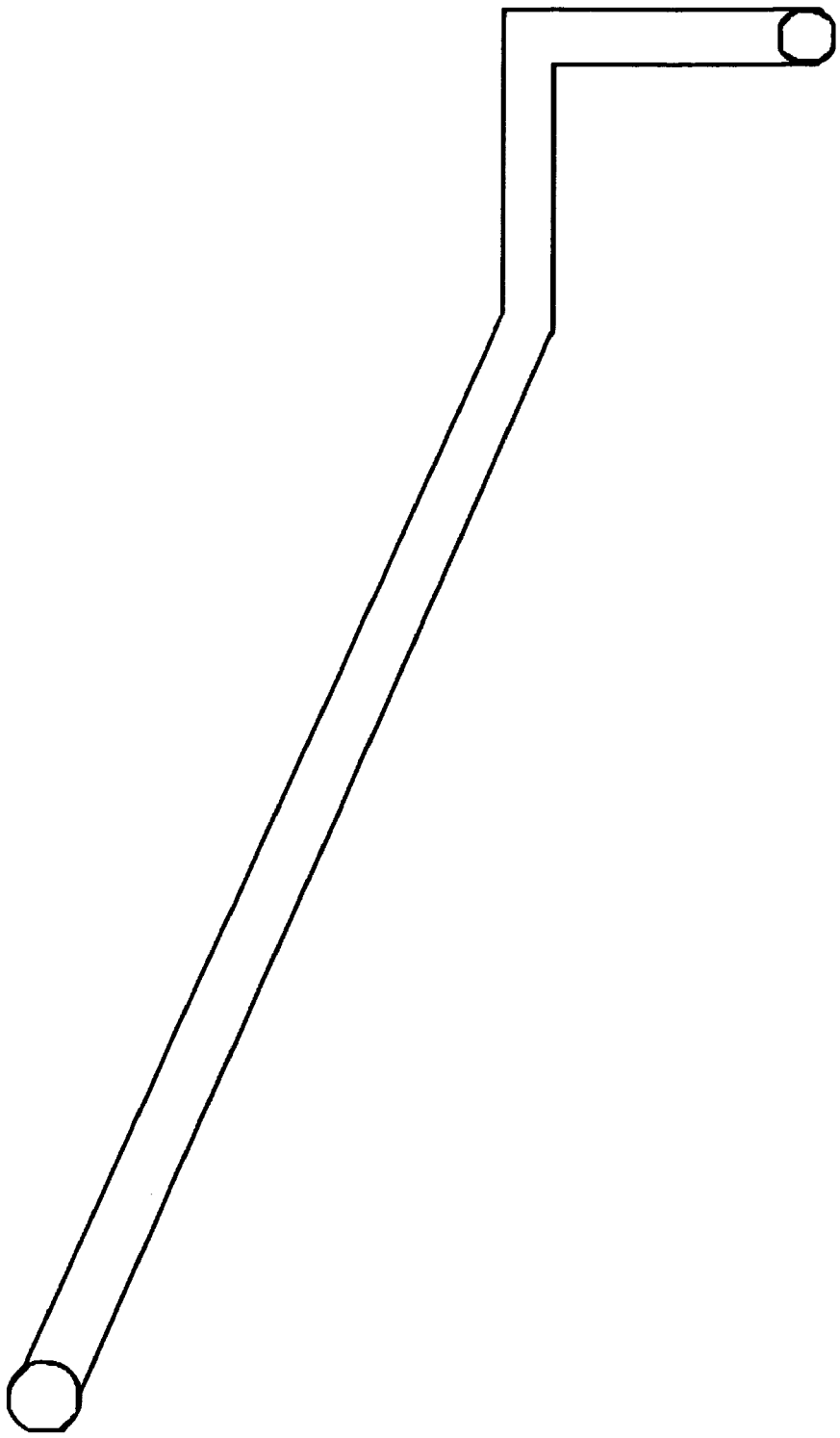
FIG. 19 shows the front view of the arm support pole.

Location of hood pouch a partial drawn chair in FIG. 16 pouch is seen sewn near the top side of rear seat assembly. Located inside pouch sewn to backside of seat are three male fasteners to accommodate three female fasteners located on the chair hood. First step remove the hood from the pouch step .2 connect the hood fasteners inside of pouch step .3 by squeezing the safety clip releases the inserted rod by hand placing the arrow tip inside the triangular hood pouch repeat step .3 for the other inserted rod step .4 upwardly slide both hood rods to the extended position until rod base closes in place step .5 gently lowering the rod arms at the fold resting in the modify opening of support pole.

Figure 1:
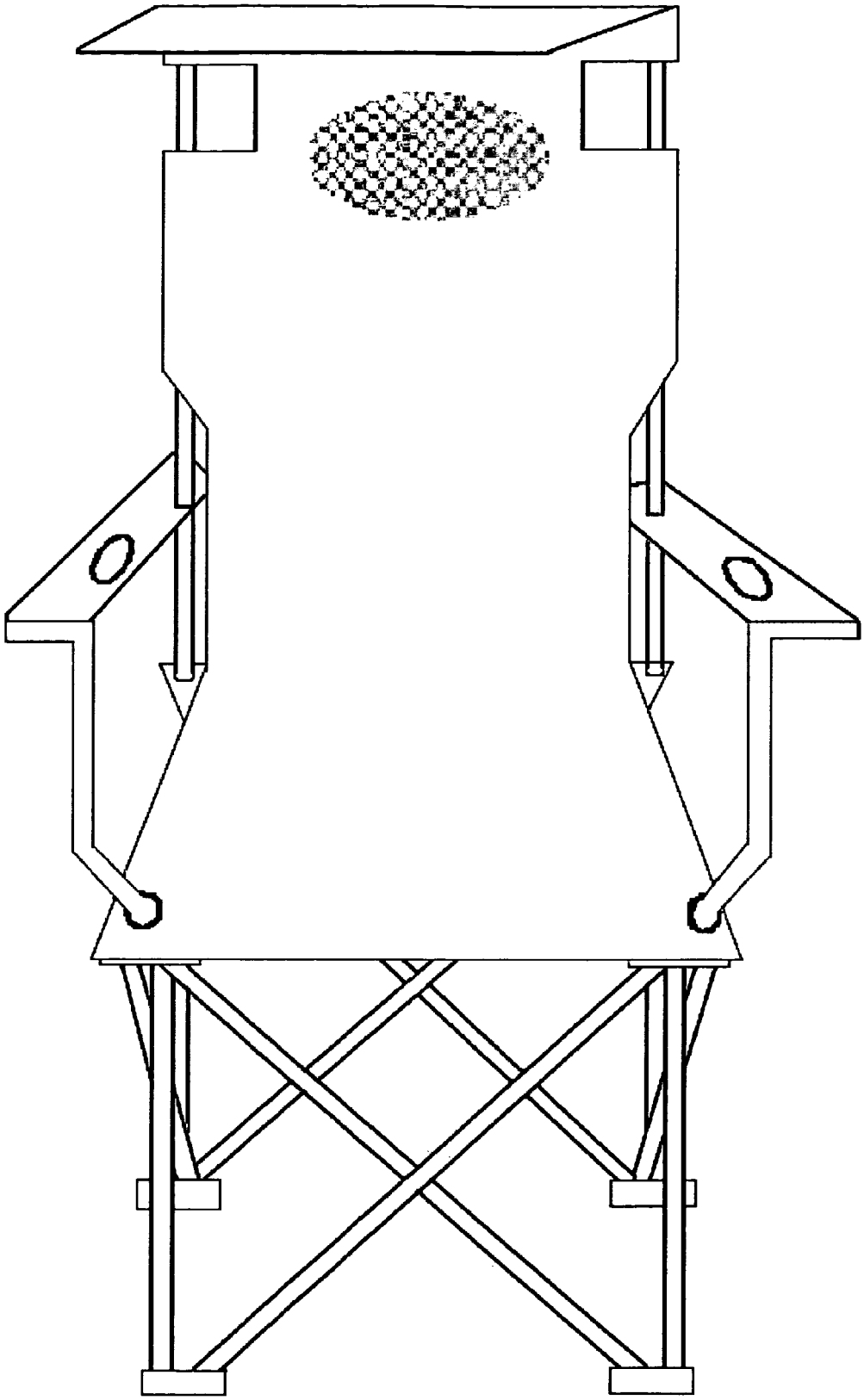
FIG. 1 shows front view of L and R chair in the extended position.
Figure 2:
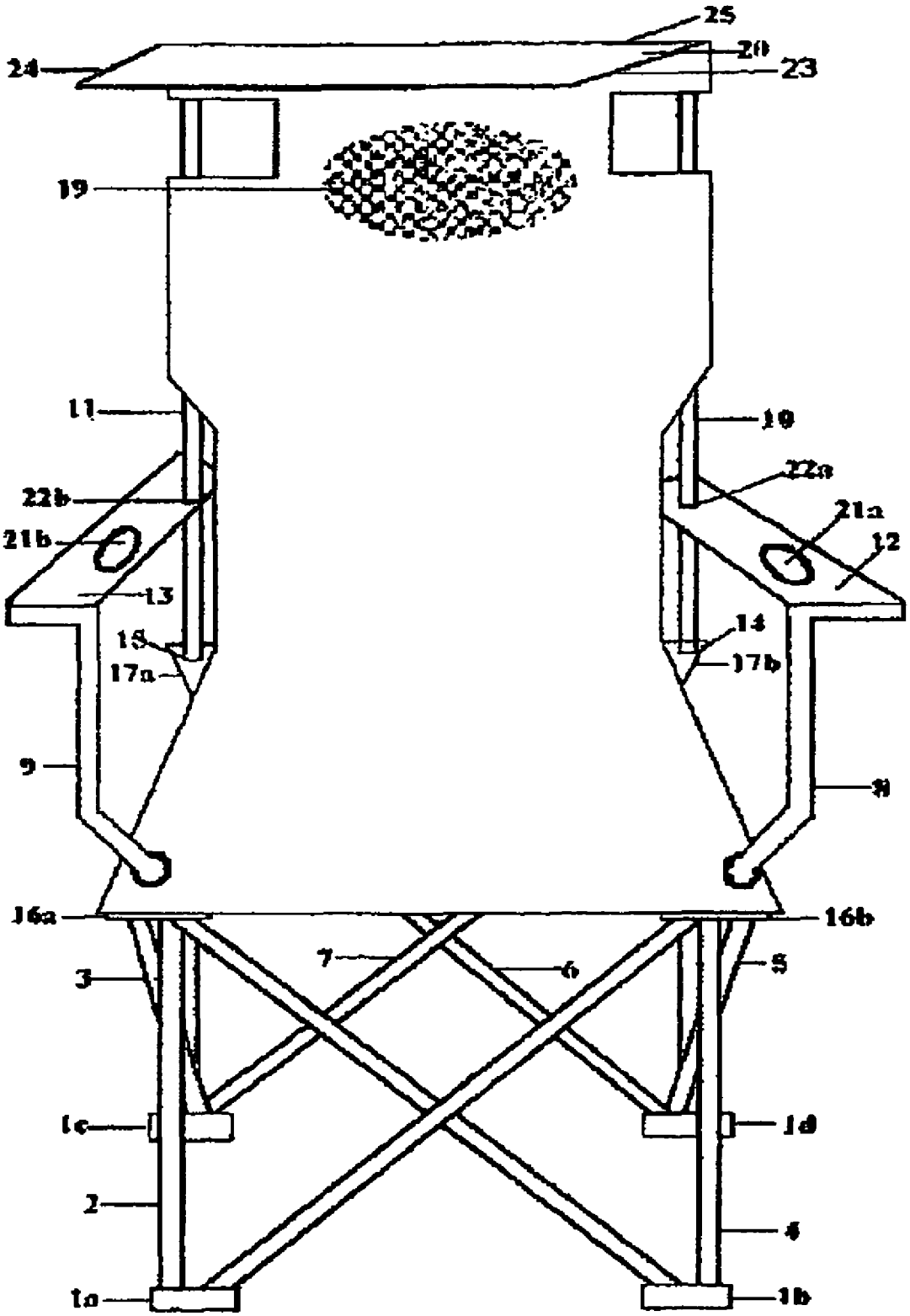
FIG. 2 shows the chair chart reference number characteristics.
Figure 3:
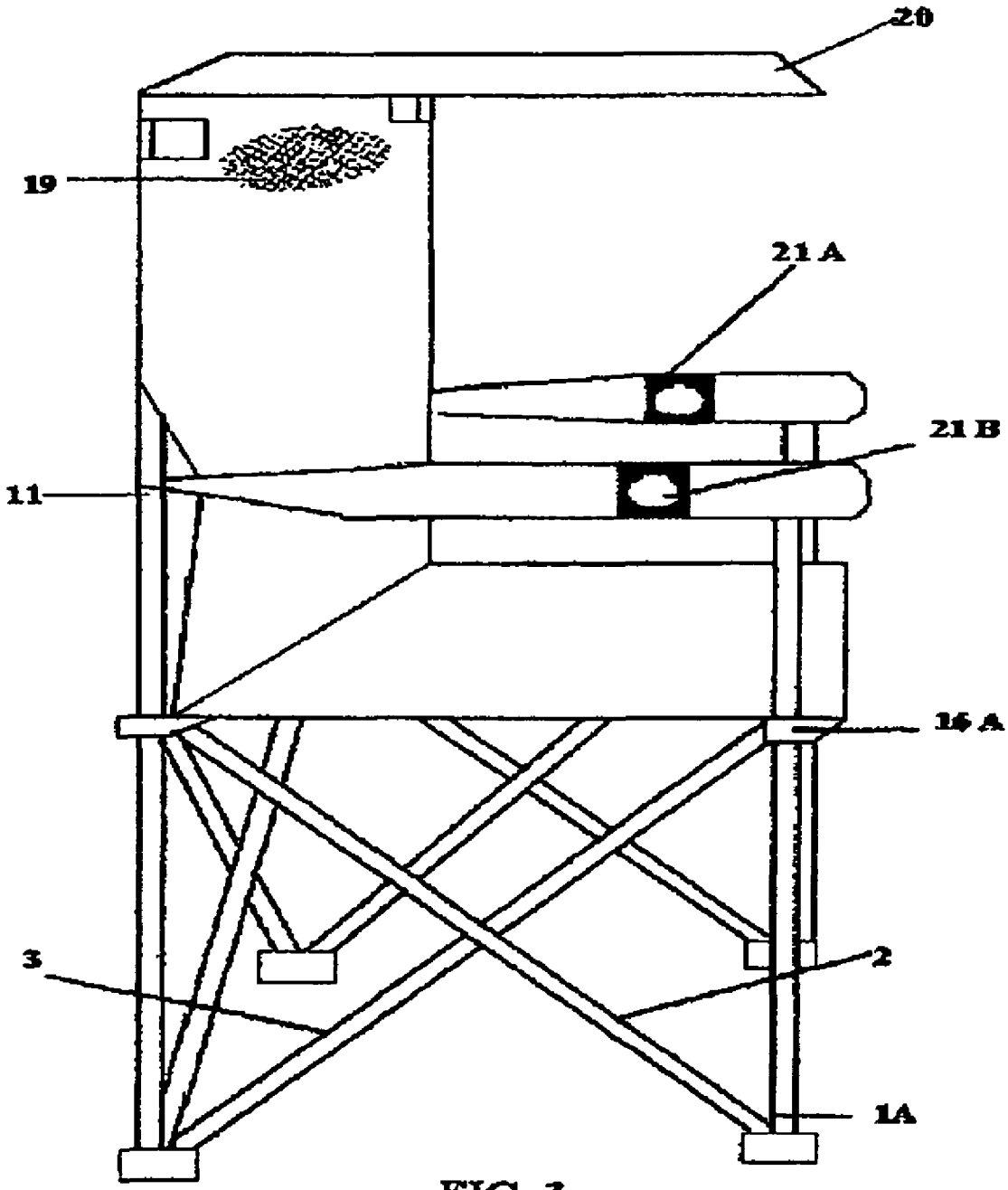
FIG. 3 shows an extended chair side profile view.
Figure 4:
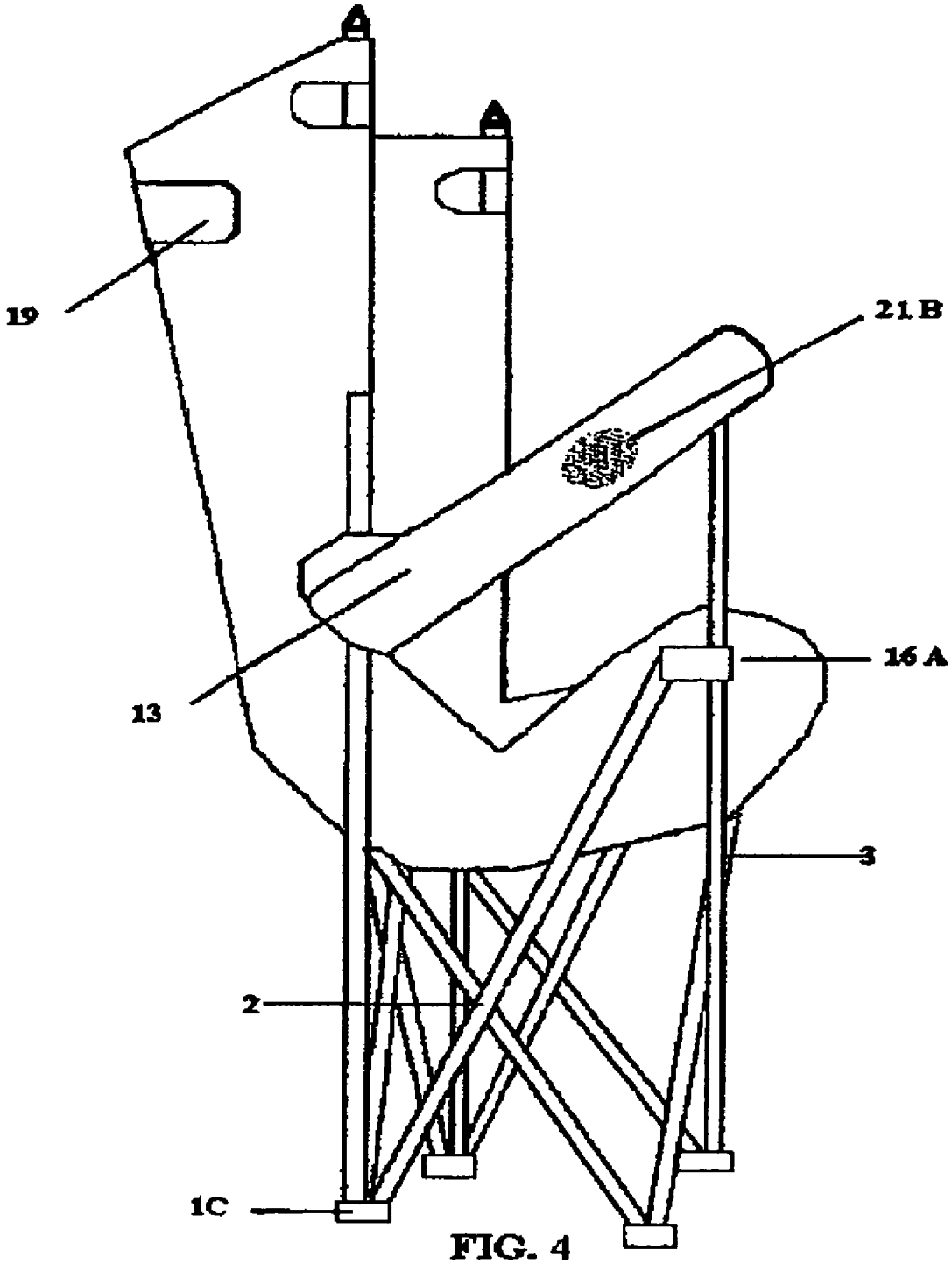
FIG. 4 is a side view of the chair in a folded position.

To remove hood simply reverse the order step 1 thru 5. The sleeves or chair arms are made of cloth material with padding so that the human arm can rest more comfortably. Arms are attach to the front support pole shown in FIG. 3, 17 also back support poles thru a ring sewn into the chair arm. Also sewn into chair arms are cup holders used for beverages. Place underneath sleeves of back support poles are sleeves adjusters, the adjusters are a fraction bigger then rear support poles and slide up or down to present comfort to the human arm.

In accordance with prior art there are some modifications to the invention as listed above these modifications made or needed for said chair to function properly, making it unique allowing a single chair to perform two functions one of which allows the sun, another that prevents direct sunlight to the upper body by providing shade. The chair described is use for the field and can be folded by a collapse motion and stored easy inside a trunk of a car.

Figure 24:
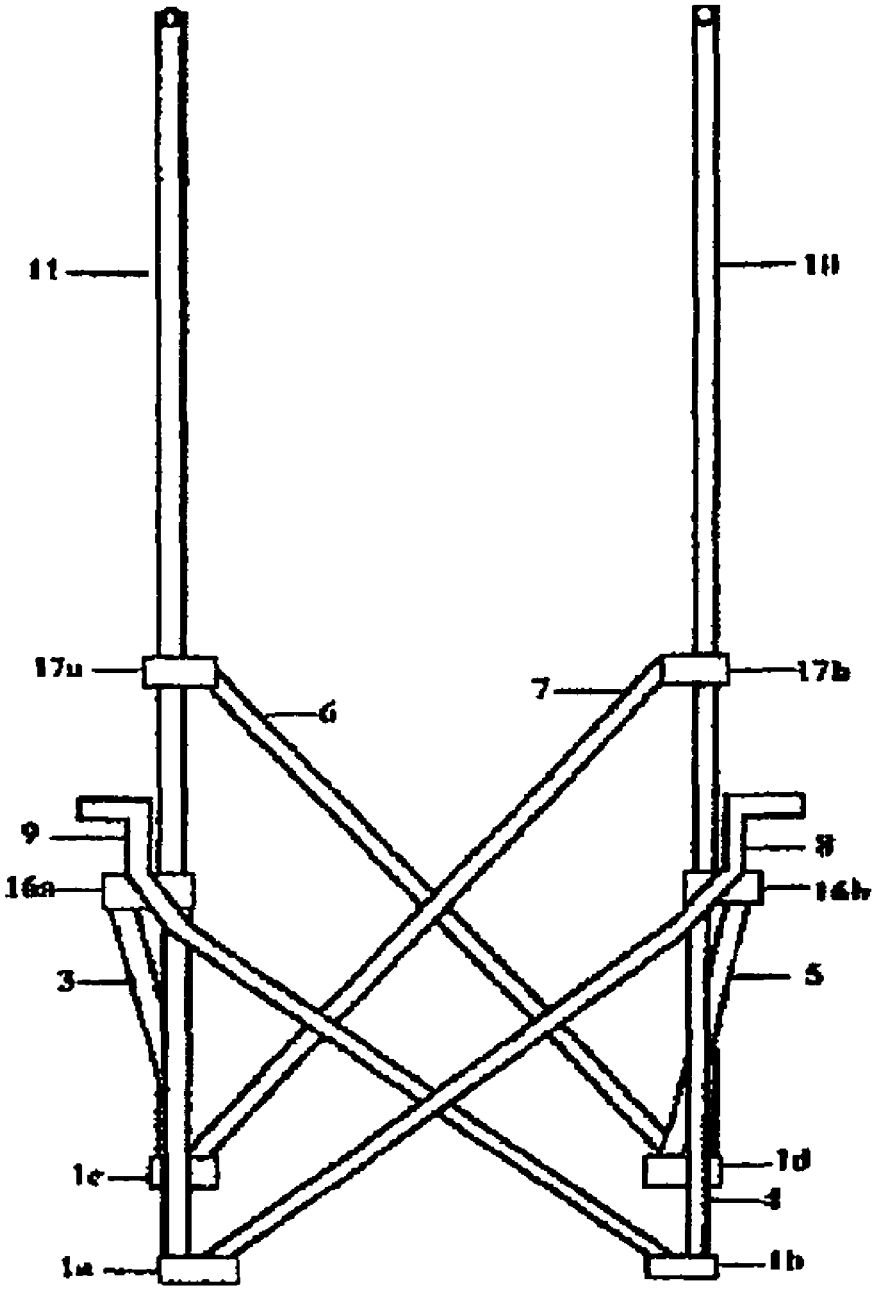
FIG. 24 shows a skeleton view of leg assembly with reference characteristics.
Figure 25:
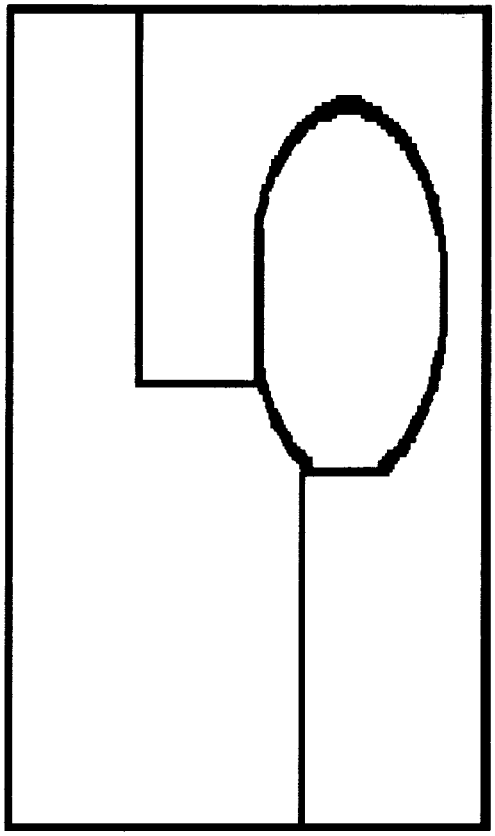
FIGS. 25*a* to 25*b* shows a split view of lower leg mount top and bottom side.
Figure 25:
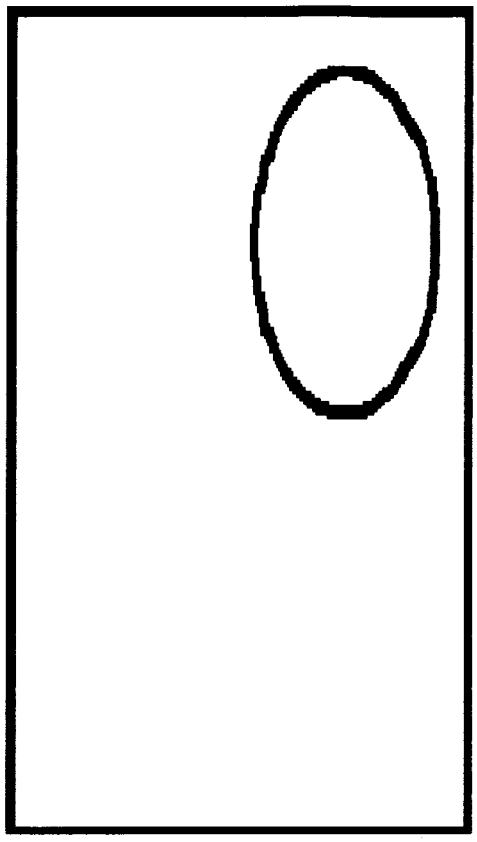
Figure 26:
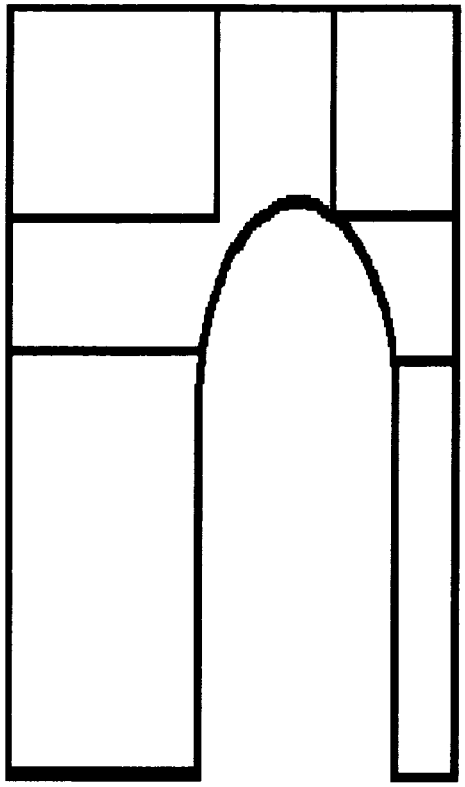
FIGS. 26*a* to 26*b* shows a split view of upper front leg mount top and bottom side.
Figure 26:
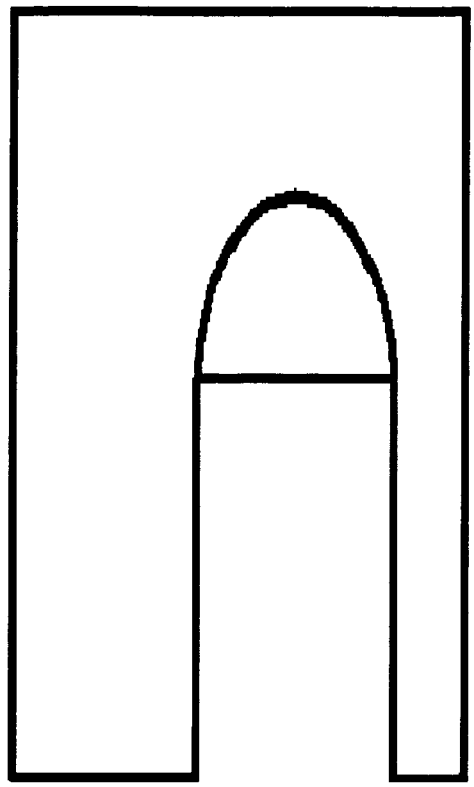
Figure 27:
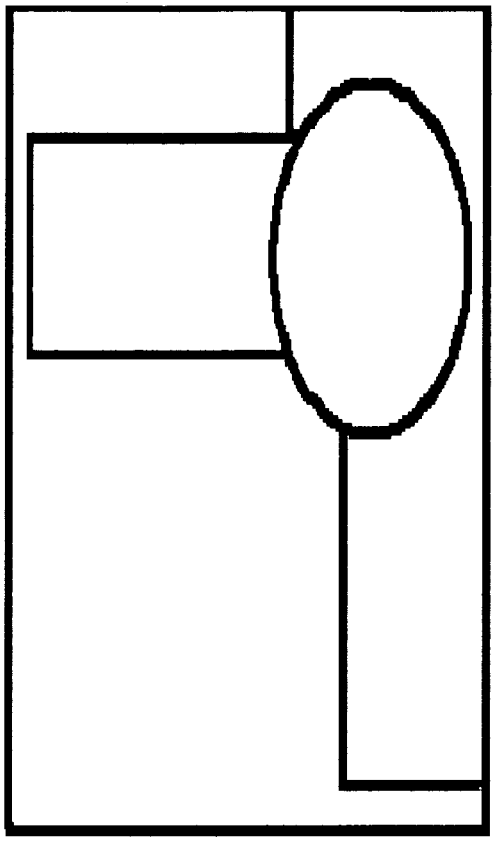
FIGS. 27*a* to 27*b* shows a split view of back upper leg mount top and bottom side.
Figure 27:
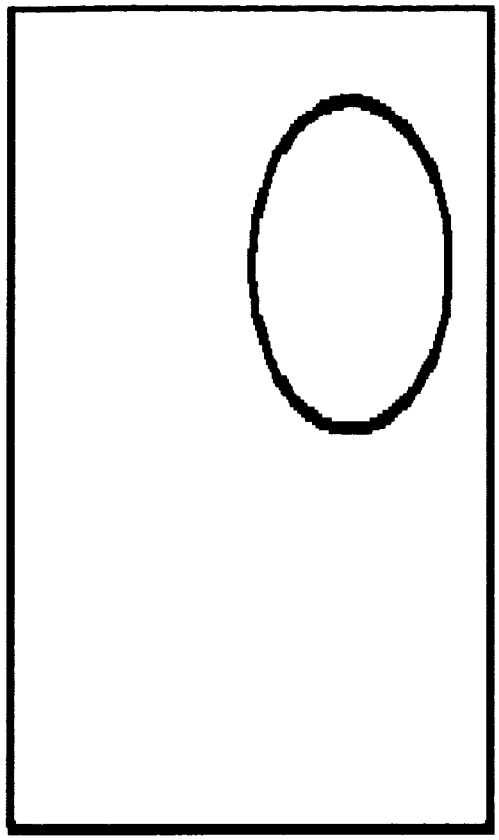

FIG. 24 shows a skeleton like frame of the embodiment chair structure modification of the back support pole length and certain opening to its tubular shape enhance it feature and play a major part of the invention and its operation.

The cytology structural drawing of FIG. 24 clearly demonstrate an apparatus of what material, machinery, equipment designed for this particular invention and functional processes to be systematically and activity carried out to anyone skilled in the art should be able to perform.

Figure 31:
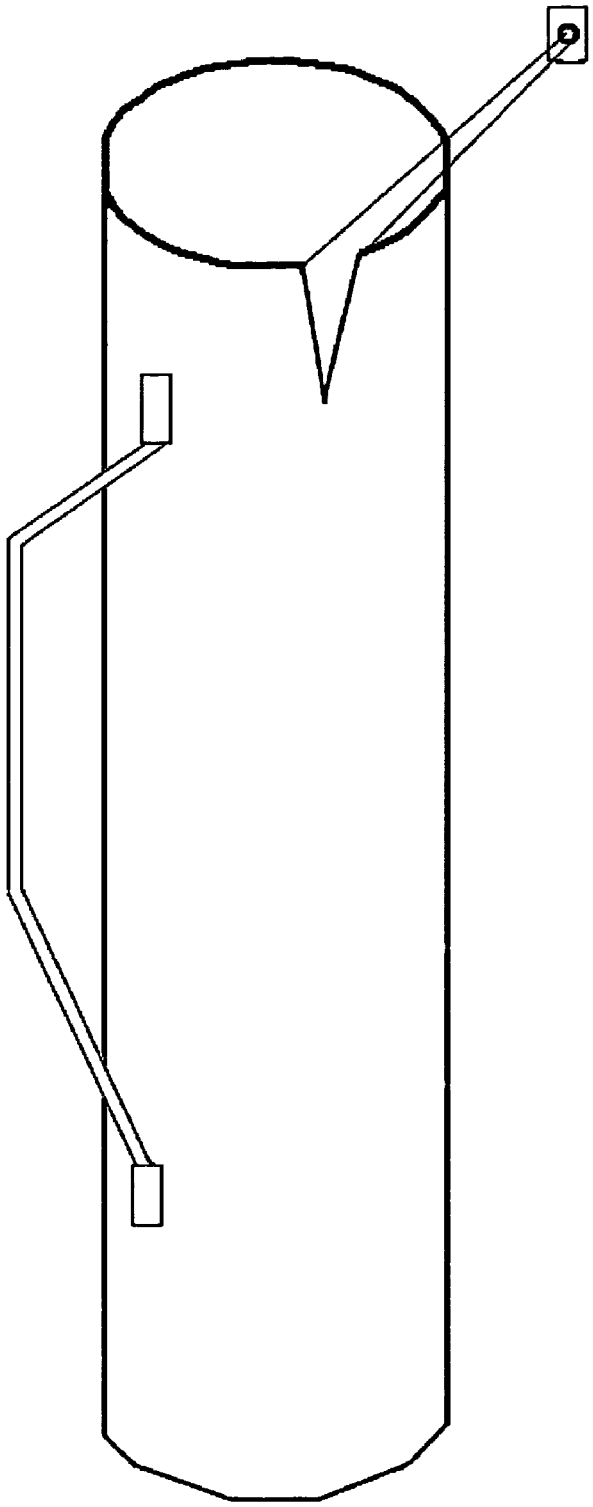
FIG. 31 shows the chair bag, which carries the L&R chair.

The carrying bag shown in FIG. 31 made of a water resistance material, modification or alteration should be made to the length and width of bag to accommodate the chair size. With its drawstring closing and strap like handle make it easy to carry to the beach, park, barbecue, or any outdoor event the carrying bag also aid or help with convenient space and storage.

| ITEM PART LIST | |
|---|---|
| 1. | 1a-1d - lower leg mount |
| 2. | 2, 3, 4, 5, 6, 7 - base support poles |
| 3. | 8, 9 - front support poles |
| 4. | 10, 11 - back support poles |
| 5. | 12, 13 - left and right chair sleeves |
| 6. | 14, 15 - left and right sleeve adjusters |
| 7. | 16a, 16b - upper front support mounts |
| 8. | 17a, 17b - rear upper leg mounts |
| 9. | 18a - from seat assembly, 18b - back seat assembly |
| 10. | 19 - mesh window |
| 11. | 20 - chair hood |
| 12. | 21a, 21b -mesh cup holders |
| 13. | 22a, 22b - sleeve washers |
| 14. | 23a, 23b, 23c - left support rod |
| 15. | 24a, 24b, 24c - right support rod |
| 16. | 25 - hood pouch |
| 17. | 26a, 26b - plastic safety lock |

What we claim:

1. A foldable chair comprising: a main body with foldable insert rods, safety locks, and rear support poles; a main seat assembly with an opening for ventilation and with a rear hood pouch; and a detachable hood with an elastic base, accommodating pouches, and fasteners attaching the hood to the main seat assembly and to the foldable insert rods wherein the foldable insert rods are inserted inside the rear support poles for movement between a retracted position housed within the rear support poles and an extended position folded over the top end of the rear support poles to support the hood above the main seat assembly, and wherein each of the foldable insert rods consists of three parts: (a) a rod base, (b) a rod arm that latches to the rod base and performs a folding motion, and (c) a rod arrow tip that screws into the rod arm to then be inserted into one of the accommodating pouches of the hood.

2. The foldable chair of claim 1, wherein each of the safety locks stabilizes the foldable insert rods from slipping and holds the foldable insert rods in place when in the retracted position to prevent injuries or damage to humans or objects, and each of the safety locks is placed between the arrow tip and the rod arm of the foldable inserts rods then inserted inside the opening of the top end of the rear support pole of the main frame.

3. The foldable chair of claim 1, wherein the main seat assembly comprises a fabric having at least one layer, the opening is an oval shaped window permanently connected to a seat back of the main seat assembly, and male fasteners are sewn near the top of the seat back above the window and extend along the width of the seat back.

4. The foldable chair of claim 3, wherein the main seat assembly further comprises a hood pouch wherein the hood pouch is of the same material as the main seat assembly and is sewn onto a rear side of the main seat assembly and near the top of the main seat assembly to overlap the male fasteners wherein an adhering material is used to open and close the hood pouch for housing the hood when not in use.

5. The foldable chair as in any one of claims 1, 3, and 4, wherein the hood further comprises a means for securing a section of the hood, the hood being made of an elastic material, of a flexible fabric, or of a cloth fabric whereas female fasteners are sewn to a rearward end of the hood and triangular pouches are sewn onto a forward end of the hood to accommodate the arrow tips of the foldable insert rods.

6. The foldable chair of claim 1, wherein the foldable chair further comprises a chair bag for holding the foldable chair when the foldable chair is in a collapsed state.

* * * * *